US006946229B2

(12) United States Patent
Suzuki et al.

(10) Patent No.: US 6,946,229 B2
(45) Date of Patent: Sep. 20, 2005

(54) TONER FOR FORMING COLOR IMAGE, IMAGE FORMING APPARATUS, AND TONER CONTAINER

(75) Inventors: Masanori Suzuki, Shizuoka (JP); Takuya Saito, Shizuoka (JP); Hiroshi Yamashita, Shizuoka (JP); Yohichiroh Watanabe, Shizuoka (JP); Takeshi Takada, Shizuoka (JP); Tsunemi Sugiyama, Shizuoka (JP); Satoshi Mochizuki, Shizuoka (JP); Yasuaki Iwamoto, Shizuoka (JP); Takayuki Koike, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 117 days.

(21) Appl. No.: 10/647,346

(22) Filed: Aug. 26, 2003

(65) Prior Publication Data

US 2004/0121256 A1 Jun. 24, 2004

(30) Foreign Application Priority Data

Aug. 26, 2002 (JP) ..... 2002-244496

(51) Int. Cl.[7] ..... G03G 9/00

(52) U.S. Cl. ..... 430/109.4; 430/108.4; 430/108.8; 430/137.15

(58) Field of Search ..... 430/109.4, 108.4, 430/108.8, 137.15

(56) References Cited

U.S. PATENT DOCUMENTS

| | | | |
|---|---|---|---|
| 6,503,676 | B2 | 1/2003 | Yamashita et al. |
| 6,593,048 | B2 | 7/2003 | Sasaki et al. |
| 6,653,037 | B2 | 11/2003 | Sawada et al. |
| 6,660,443 | B2 | 12/2003 | Sugiyama et al. |
| 6,667,141 | B2 | 12/2003 | Iwamoto et al. |

*Primary Examiner*—Mark A. Chapman
(74) *Attorney, Agent, or Firm*—Oblon, Spivak, McClelland, Maier & Neustadt, P.C.

(57) ABSTRACT

A color toner which gives a suitable image gloss and has an excellent color reproducibility, which has sufficient anti-offset properties even when a release oil is not coated on a fixing roller or is coated in only a small amount, and which has excellent transfer properties, durability, and charge stability relative to humidity is disclosed. Also, an image-forming apparatus using the color toner and a toner container filled with the color toner are disclosed. The color toner comprises a continuous phase of a resin containing a urea-modified polyester resin; and a modified resin dispersed in the continuous phase, wherein the modified resin contains a release polymer portion containing a release polymer; and a modified portion containing a plurality of vinyl monomer units, the modified portion having an average ester group concentration of 8% by weight to 30% by weight.

22 Claims, 5 Drawing Sheets

TONER FOR FORMING COLOR IMAGE, IMAGE FORMING APPARATUS, AND TONER CONTAINER

BACKGROUND OF THE INVENTION

1. Field of the Invention

The present invention relates to a toner for developing an electrostatic image which renders an electrostatic image formed on photoconductor surface visible, a developer containing the same, an image-forming apparatus using the same, and a toner container in which a color toner is contained.

2. Description of the Related Art

In the case of the dry method, an electrostatic image formed in electrophotography, electrostatic printing, electrostatic recording, and the like, is developed by a dry toner consisting mainly of a binder resin and a colorant and having a triboelectric charge given by a charger. Then the image is transferred and fixed on a sheet of paper. In order to obtain a high quality image, one of the most important technical challenges is the capability to faithfully develop a latent image formed on a photoconductor in any circumstances using a toner. Various attempts have been made to date.

Properties which are required for a developing agent to achieve high quality include storage property (blocking resistance), transport property, transfer property, charge property, fixing property, and the like.

As a general method to fix, or fuse, a dry toner image on a recording medium, it is common to use contact heat fusing in which a heated roller or belt is pressed against the toner image to fix it on the medium. This method is advantageous in that it has high thermal efficiency, is capable of high-speed fusing, and can give gloss and transparency to color toners. On the other hand, since the surface of the heat fusing member and a molten toner are in contact under a pressure and subsequently pulled apart, a portion of the toner image remains adhered to the surface of the fusing roller and then is applied on another image. Such phenomenon is called offset. To prevent the offset phenomenon, the method which has generally been employed is to form the surface of a fusing roller with silicone rubber or a fluorinated resin, which have excellent release property, and further apply releasing oil such as silicone oil on the surface of the fusing roller. This method is extremely effective in terms of preventing toner offset, but it requires a device to supply the release oil and a large fusing device, resulting in higher cost. Therefore, the trend for monochrome toners is to employ a method in which the viscoelasticity of a molten toner is raised by adjusting the molecular weight distribution of a binder resin or by using other ways so that the molten toner is not torn apart in the middle, and, moreover, a release agent such as wax is added in the toner to greatly reduce, if not eliminated, the use of release oil on the fusing roller.

However, in forming of a color image in full-color electrophotography, which generally uses three color toners of the three primary colors (yellow, magenta, and cyan) or four color toners by adding a black toner and laminate these toners to reproduce all the colors, a need exists for toners which are excellent in color reproducibility and which can give sharp full-color images. In order to obtain a sharp full-color image, it is required to reduce light scattering by making the surface of a fused toner image flat and smooth to a certain degree and also to lower the viscoelasticity when the toner is molten. Therefore, in forming a full-color image, an offset is more likely to occur than a no-gloss monochrome toner, thereby making it harder to realize an fusing device with no oil or little oil application. Additionally, when a release agent is added in a toner, the adhesiveness of the toner increases and the transfer property to transfer paper subsequently decline. Also, a problem arises as the release agent in the toner contaminates carrier particles and other members which are tribocharged (charged by friction) and reduces their charging property, thereby lowering the durability of the developer agent.

Regarding fusing methods, many cases employ heated roller fusing, which has a simple device configuration and easy handling. However, the heated roller fusing, which has conventionally been used by many, has the following problems:

(1) A certain period of time is required until the heating roller reaches a desired temperature (wait-time).

(2) It is necessary to maintain the heating roller at the optimum temperature in order to prevent bad fusing and offset phenomenon, which are caused by the fluctuation of the heating roller temperature due to the passing of recording materials or other external factors. To do so, the heat capacity of the heating roller or a heating member must be sufficiently large.

In addition, for full-color toners, which are generally low in viscosity, there are other problems:

(3) Due to the curvature of the roller, offset occurs and the toner is taken up by the roller during paper output. Therefore, it is necessary to apply release oil and equip the system with an oil tank.

In light of these problems, heated belt fusing has been suggested, and in addition, belt fusing techniques which applies no oil (oil-less method) or very little oil have been suggested. However, whereas it is common in full-color roller fusing to use a roller with a thick elastic member and apply a high pressure, in belt fusing, the applying pressure is small and its effect as a means to obtain high gloss is small.

There are several ways to achieve high gloss in belt fusing such as those described below.

Disclosed in Japan Patent Application Laid-Open (JP-A) No. 02-160250 is a method which defines an average particle diameter and an allowable amount of particles which are either too small or too large so as to reduce the roughness of a toner layer surface. However, in this case, a glossy image is not necessarily obtained even if the toner is adhered with little roughness on the recording material.

For increasing flatness and obtaining high gloss, in JP-A No. 11-125948, a method is described that defines the surface roughness of the image on an OHP sheet. However in this case, as the surface properties of an OHP sheet are different from those of paper, even if the surface roughness of the image on the OHP sheet is defined, offset and glossiness are not necessarily good depending on the surface properties of the paper.

Although glossy images have often been desired with full color images, demands for printer output are now large and therefore too much gloss is sometimes not desirable. Even more, a non-glossy image may be desired in some cases. Hence, it is required to be able to obtain images of different glossiness depending on the case. To address this need, JP-A No. 04-194967 proposes a fixing method wherein one can select between high gloss and no gloss with one fixing apparatus. However, conditions for obtaining high gloss are disadvantageous for offset, so depending on the conditions, offset tolerance may not be sufficient. Specifically, there is a problem that although offset does not occur in the solid area, it does in the halftone parts (fine offset).

Also, if the dependency of the gloss under conditional changes is too large, the gloss difference becomes so large that the glossiness is not stable under different conditions.

Various types of toner have been discussed in the related art. For example, JP-A No. 08-220808 proposes a toner using a linear polyester resin having a softening point of 90° C. to 120° C. and carnauba wax, JP-A No. 09-106105 proposes a toner containing a resin and wax which are compatible and have different softening points, JP-A No. 09-304964 proposes a toner specifying a melt viscosity of a polyester resin and wax, JP-A No. 10-293425 proposes a toner containing a polyester resin having a softening point of 90° C. to 120° C., rice wax, carnauba wax and a silicone oil, and JP-A No. 05-61242 proposes a wax-included polymer toner. Although all of these toners gave a suitable gloss, anti-offset properties were insufficient when release oil was not applied or was applied in only a small amount on the fixing roller, and the toners did not have very good transfer properties, durability, charge stability relative to humidity, or pulverizing properties.

In recent years, market demands for high-quality images are increasing, and as sufficiently high image qualities can no longer be obtained with a toner having a weight average particle diameter of 9 μm to 15 μm of the related art, a toner of still finer particle diameter is required. As the specific surface area increases the smaller particle diameter of the toner is, the powder fluidity of the parent colorant particles decreases, a large amount of external additives must be added as a surface treatment to confer fluidity. If it is attempted to obtain a desired fluidity, moreover, the aforesaid side-effects become more obvious. Also, the release agent separates due to stress and the like. In particular, toners manufactured by pulverization have a narrow molecular weight distribution and the brittle release agent easily becomes a pulverization interface, so the surface of the release agent became exposed which was frequently found in fine powder. Therefore, making the toner particles finer to obtain high image quality imposes a stricter requirement on filming.

In order to resolve these issues, a toner having small particle diameters and a narrow distribution of particle diameters is ideal. However, conventional pulverized toners are manufactured by melt mixing a colorant, a charge control agent, an anti-offset agent, and the like in a thermoplastic resin; uniformly dispersing the mixed composition; pulverizing the composition; and classifying the pulverized composition. With such toner manufacturing process, the distribution of toner particle diameters is likely to be wide. Therefore, if one intends to obtain a reproduced image having a good resolution and tone, he should, for example, remove small particles having diameters of 5 μm or less and large particles having diameters of 20 μm or more by classification, resulting in very low yield, which is a drawback. Particularly with color toners, it is difficult for the pulverizing method to uniformly disperse a colorant, charge control agent, and the like in a thermoplastic resin. Uneven dispersion of these components and agents adversely affects the fluidity, developing properties, durability, image quality, and the like of the toner.

Recently, toner manufacturing processes using polymerization has been suggested and put into practice to overcome these problems with the pulverizing method. Polymerization can omit conventional manufacturing steps of pulverizing and kneading, and its low energy consumption, reduction of production time, improvement of yields of manufacturing steps, and the like largely contribute to cost reduction. Moreover, it is easy to make toner particles small and at the same time set the distribution of particle sizes narrower than pulverization method, contributing also to improving quality. Well known techniques include, for example, suspension polymerization, emulsion polymerization, polymer suspension method, and the like.

In suspension polymerization, polymerization-capable monomers, a polymerization initiator, and toner composition materials such as colorants are suspended in an aqueous medium in which a dispersant exists, and then polymerized to obtain toner particles. The problem of this method is that the raw material which can be used is limited to styrene-acrylic resin and therefore polyester, which is suitable for full-color toners, cannot be used. Another problem is that it is difficult to allow the distribution of molecular weight to have two peaks or to control the distribution precisely to obtain low temperature fixing properties and hot offset resistance properties at the same time. Also, among other problems, insufficient cleaning is likely to occur because the shapes of obtained particles are spherical.

Emulsion polymerization is a method for obtaining toner particles including emulsifying polymerization-capable monomers and a polymerization initiator in a water containing a surfactant, conducting polymerization, and allowing formed particulates to aggregate and cohere. Since the method provides irregularly shaped particles, it is superior to suspension polymerization toners in cleaning properties. However, the emulsion polymerization, just like suspension polymerization, can hardly use polyester and is difficult to control molecular weight. Moreover, a considerable amount of the surfactant remains even after being washed with water not only on the surface but also inside the particles, therefore leading to deteriorating the environmental stability of the charge of the toner and widening the distribution of charges, which result in intolerable background shading on output images. Further, since the remaining surfactant contaminates a photoconductor, charge roller, developing roller, and the like, they cannot exhibit their inherent charging capabilities.

In polymer suspension method, a polymer which is used as a binder resin and toner composition materials are dispersed or dissolved in a volatile solvent such as a low-boiling point organic solvent, then the mixture is emulsified or made into droplets in an aqueous medium containing a dispersant, and then the volatile solvent is removed. The method is therefore an in-water particle manufacturing method which is not accompanied by a polymerization reaction. This polymer suspension method is superior in that it can use polyester, but since it includes a step for dispersing or dissolving the toner composition materials in the solvent, it is not possible to use high-molecular weight and/or cross-linked resins, and the method merely forms particles. Therefore, adjustment of polymerization reaction including molecular weight designing is not possible, and accordingly, fixing properties cannot be controlled sufficiently.

SUMMARY OF THE INVENTION

An object of the present invention is to provide a color toner which gives a suitable image gloss and has an excellent color reproducibility, which has sufficient anti-offset properties even when a release oil is not coated on a fixing roller or is coated in only a small amount, and which has excellent transfer properties, durability, and charge stability relative to humidity; an image-forming apparatus using thereof; and a toner container filled thereby. Further, another object of the present invention is to provide a color toner, a developing agent, an image-forming apparatus, a toner container and an image-forming process cartridge which give a suitable image gloss and has excellent color reproducibility, which have sufficient anti-offset properties even when a release oil is not coated on a fixing roller or is coated in only very small amount, and which have excellent transfer properties, durability, and charge stability relative to humidity, even when a belt heat fixing method is employed wherein the waiting time until the fixing member reaches a predetermined temperature is short. In addition, another object of the present invention is to provide an efficient image-forming method providing the aforementioned properties.

After exhaustive studies aimed at resolving the aforesaid problems, the Inventors conceived the present invention.

A first aspect of the present invention provides a color toner for forming an image, comprising:

a continuous phase of resin containing a urea-modified polyester resin; and a modified resin dispersed in the continuous phase, wherein the modified resin contains:

a release polymer portion containing a release polymer; and a modified portion containing a plurality of vinyl monomers, the modified portion having an average ester group concentration of 8% by weight to 30% by weight, wherein the color toner is formed by a process comprising:

emulsifying and suspending an organic solvent containing a modified polyester resin capable of forming a urea bond in an aqueous medium under an existence of a modified resin and a release agent;

allowing polymerization in the aqueous medium;

removing the organic solvent from the aqueous medium; and washing the aqueous medium.

DESCRIPTION OF THE PREFERRED EMBODIMENTS

Figure 1:
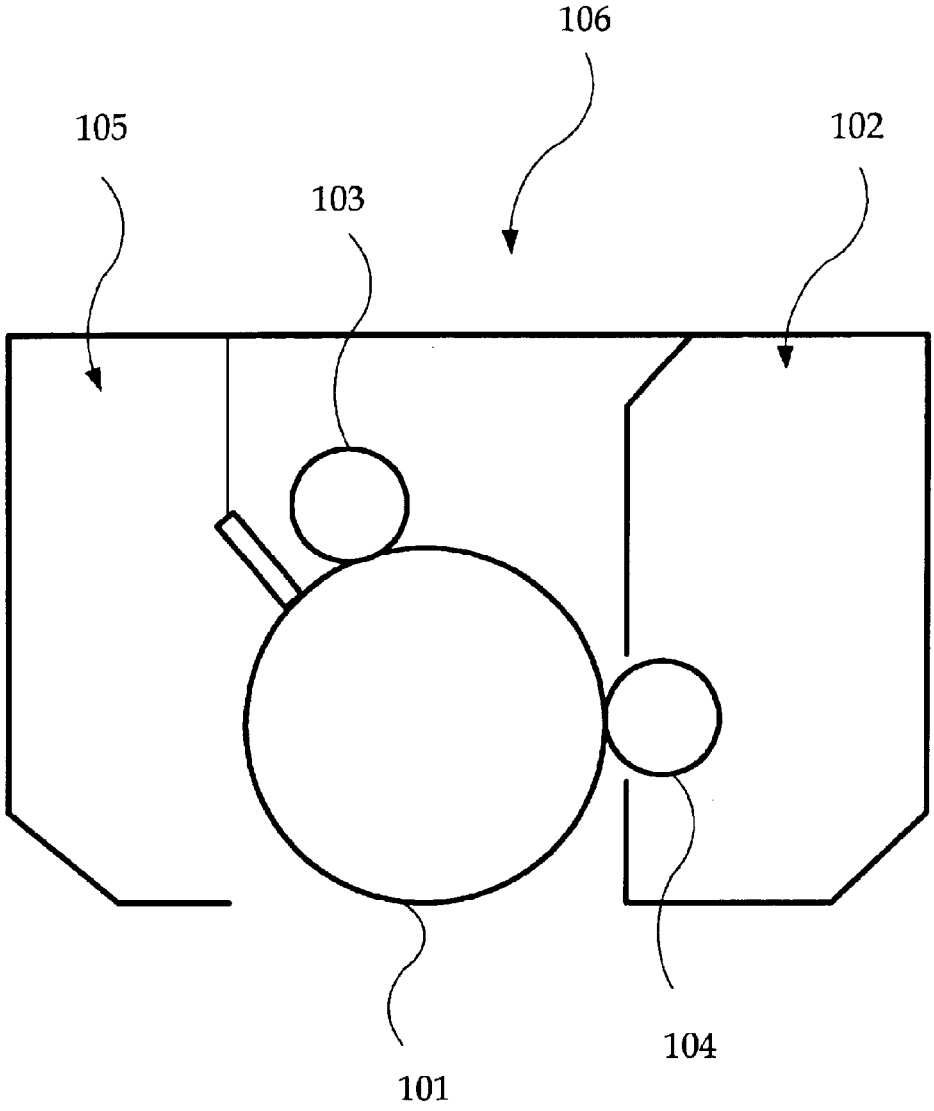
FIG. 1 is a schematic view of an example of a belt fusing device.

The present invention will be described in detail hereinafter.

The present invention relates to an image-forming color toner containing at least a colorant, a binder resin and a wax release agent, and has the following characteristics:

(1) A toner of the present invention can be obtained by a process including: emulsifying and suspending an organic solvent containing a modified polyester resin capable of forming a urea bond in an aqueous medium under an existence of a modified resin and a release agent; allowing polymerization in the aqueous medium; removing the organic solvent from the aqueous medium; and washing the aqueous medium. It is possible to obtain a toner having a molecular weight substantially equal to design, and therefore it is relatively easy to obtain a toner having required properties. The reason is presumed that the extent of the addition polymerization, which proceeds sequentially, can be adjusted relatively easily by adjusting the amount of reactants or by other conditions.

(2) A binder resin which contains a modified polyester resin capable of forming a urea bond and a release agent (which is mainly a wax release agent) are mutually incompatible, and the binder resin and the release agent have a structure wherein the wax release agent is dispersed in the binder resin forming a continuous phase.

(3) A modified resin, which is incompatible with the binder resin, is dispersed in the binder resin in a non-dissolved state.

(4) The modified resin contains at least a part of the wax release agent. In this case, the wax release agent is included in the modified resin. In particular, it is presumed that the wax release agent is compatible with and selectively included in a release polymer (which is mainly wax) part, which is a constitutive element, of the modified resin. As a result, in a toner of the present invention, domains of the wax release agent exist sufficiently in the binder resin so that when necessary, a sufficient amount of the release agent is discharged from the binder resin to provide the necessary releasability.

(5) The modified resin has at least a portion of its release polymers modified by vinyl monomers having an average ester group concentration of 8% by weight to 30% by weight, and a basic configuration of the modified resin includes a main chain containing a release polymer (such as wax) and side chains (graft chains) containing vinyl polymers. The side chain, which contains vinyl monomers, contains a vinyl monomer component having ester groups, an average ester group concentration in a vinyl polymer chain being 8% by weight to 30% by weight. Since the modified resin includes urea bonds, it is superior to pure polyester resins in humidity resistance and also in offset resistance due presumably to intramolecular cohesiveness.

In the modified resin of the present invention, the release polymer, which constitutes a portion of the modified resin, may be selected from any wax known in art, as long as it enables a graft polymerization. In those, polyolefin resins (polyolefin wax) are preferred, and polyolefin resins are more preferred.

Examples of olefins having the aforesaid polyolefin resins, are ethylene, propylene, 1-butane, isobutylene, 1-hexane, 1-dodecine, 1-octadecine, and the like. Examples of polyolefin resins are olefin polymers, oxidized olefin polymers, modified olefin polymers, copolymers of other monomers which can polymerize with olefins, and the like.

Examples of olefin polymers are polyethylene, polypropylene, ethylene/propylene copolymer, ethylene/1-butene copolymer, propylene/1-hexene copolymer, and the like.

Examples of oxidized olefin polymers are oxides of the aforesaid olefin polymers.

Examples of modified olefin polymers are maleic acid derivatives (maleic anhydride, monomethyl maleate, monobutyl maleate and dimethyl maleate, and the like) adducts of the aforesaid olefin polymers.

Examples of copolymers of other monomers capable of copolymerization with olefins, are copolymers of monomers such as unsaturated carboxylic acids [(meth) acrylic acid, itaconic acid, maleic anhydride, and the like], and unsaturated carboxylic alkyl esters [(meth)acrylic alkyl (C1 to C18) ester, maleic alkyl (C1–C18) ester, and the like], and olefins.

According to the present invention, the polymer structure may contain a polyolefin structure, but it is not absolutely necessary for the monomer to have an olefin structure therein. For example, polymethylene (Sazole wax and the like) may also be used.

Of these polyolefin resins, olefin polymers, oxidized olefin polymers and modified olefin polymers are preferred, polyethylene, polymethylene, polypropylene, ethylene/propylene polymer, oxidized polyethylene, oxidized polypropylene and maleic polypropylene are more preferred, and polyethylene and polypropylene are particularly preferred.

A softening point of the aforesaid polyolefin polymers is generally from about 80° C. to about 170° C., preferably from 90° C. to 160° C., and more preferably from 100° C. to 155° C. If the softening point is higher than about 80° C., toner fluid properties are good. If the softening point is lower than about 170° C., there is a sufficient mold releasing effect. Further, a number average molecular weight of the polyolefin resin is generally about 500 to about 20000 and a weight average molecular weight is about 800 to about 100000, preferably, the number average molecular weight is 1000 to 15000 and the weight average molecular weight is 1500 to 60000, and more preferably, the number average molecular weight is 1500 to 10000 and the weight average molecular weight is 2000 to 30000. Mw/Mn is 1.1 to 7.0, and preferably 1.3 to 4.0. A penetration of the polyolefin resin is generally about 5.0 or less, preferably 3.5 or less, and more preferably 1.0 or less.

Examples of vinyl monomers forming part (the modified part) of modified resins (modified part) include alkyl (1 to 5 carbon atoms) esters of unsaturated carboxylic acids [methyl (meth)acrylate, ethyl (meth)acrylate, butyl (meth)acrylate, 2-ethyl hexyl (meth)acrylate, and the like], and vinyl ester monomers [vinyl acetate and the like]. Of these, alkyl (meth)acrylate is preferred, and alkyl (meth)acrylate having 1 to 5 carbon atoms in the alkyl chain is more preferred.

Other comonomers apart from aforesaid monomers can also be used in combination with the aforesaid vinyl monomers. These comonomers include aromatic vinyl monomers, examples being styrene monomers [styrene, α-methylstyrene, p-methylstyrene, m-methylstyrene, p-methoxystyrene, p-hydroxystyrene, p-acetoxystyrene, vinyl toluene, ethyl styrene, phenyl styrene, benzyl styrene, and the like]. Of these, styrene is preferred.

A modified part of a modified resin of the present invention is preferably a vinyl polymer including at least one of an alkylester of an unsaturated carboxylic acid and a vinylester monomer, and a styrene monomer as monomer units.

As for the molecular weight of the vinyl polymer, a number average molecular weight is about 1500 to about 100000 and a weight average molecular weight is about 50000 to about 200000, preferably, the number average molecular weight is 2500 to 50000 and the weight average molecular weight is 6000 to 100000, and more preferably, the number average molecular weight is 2800 to 20000 and the weight average molecular weight is 7000 to 50000.

A glass transition temperature (Tg) of this vinyl polymer is generally from about 40° C. to about 90° C., preferably from 45° C. to 80 ° C. and more preferably from 50° C. to 70° C. If Tg is higher than about 40° C., excellent storage properties are obtained, and if it is lower than about 90° C., low excellent temperature fixing properties are obtained.

In the modified resin according to the present invention, the average ester group concentration of the modified part (for example, side chain) is defined by the following formula:

$$\text{Average ester group concentration} = \sum\left(\frac{44}{Mwi}Wi\right)$$

wherein, "Mwi" represents a molecular weight of ester group-containing monomer, and "Wi" represents a proportion of ester group-containing monomer with respect to whole monomer forming modified part (% by weight).

An average ester group concentration in this side chain is 8% by weight to 30% by weight, and preferably 10% by weight to 25% by weight.

If the average ester group concentration is less than about 8%, compatibility with the binder resin is poor, making it difficult for the wax release agent to disperse in the modified resin, which result in the dispersion particle diameter of the wax release agent growing larger, the wax release agent being exposed at a toner surface more easily, and the wax release agent adversely affecting chargeability and the like due to its adhesion to carrier, photoconductor, image-developer, and the like. If it is higher than 30%, the compatibility with the wax release agent becomes so large that the wax release agent disperses in very small particles in the modified resin, in which case the wax release agent does not come out of the toner when the toner is fixed, and therefore releasability is reduced.

A ratio of the content [A] of the release polymer in the modified resin to the content [B] of the vinyl monomer ([A]/[B]) is preferably in the range of 1 to 50, and more preferably in the range of 5 to 30. If the ratio is more than 50, the release polymer itself is dispersed in the composition, so the added wax release agent may not be sufficiently dispersed. If the ratio is less than 1, the graft copolymer is not fully incompatible with the added wax release agent, which impairs dispersion of the wax release agent.

The modified resin embraces wax as the releasing agent of the toner. In order to ensure the presence of an interface with the binder resin, it is preferred that the modified resin content "Y" in the toner and the wax release agent wax content "X" in the toner satisfy the following formula:

$$0.1 \leqq Y/X \leqq 3$$

wherein, if "Y/X" is less than about 0.1, dispersion of the wax release agent is insufficient, the dispersion particle diameter increases and transparency declines. If "Y/X" is larger than about 3, degradations occurs in the low temperature fixing properties of the polyester or polyol, and heat storage properties. The preferred ratio Y/X is from about 0.5 to about 2.5.

The modified resin used in the present invention may be manufactured by any of the methods known in the art. Specifically, the release polymer forming the main chain of the modified resin is dissolved in an organic solvent, the vinyl monomer used to obtain the vinyl polymer forming the side chain is added to the organic solvent, and this release polymer and vinyl monomer are polymerized by a graft polymerization reaction in the presence of a polymerization initiator such as an organic peroxide in the organic solvent.

In the modified resin obtained by the aforesaid graft polymerization, unreacted release polymer and vinyl polymer produced by polymerization of the vinyl monomer with itself are also present, but in the case of the present invention, there is no need separate the release polymer and vinyl polymer from the obtained resin, and the modified resin may conveniently be used as a mixed resin containing these constituents.

In the mixed resin, a content of unreacted release polymer is about 5% by weight or less, and preferably 3% by weight or less. Also, a content of vinyl polymer produced by polymerization of vinyl monomer with itself is about 10% by weight or less, and preferably 5% by weight or less. In the case of the present invention, a proportion of graft polymer resin in the mixed resin is specified to be about 85% by weight or more, and preferably 90% by weight or more.

The proportion of graft polymer resin in the aforesaid mixed resin, a molecular weight thereof and a molecular weight of the vinyl polymer may be conveniently adjusted depending on conditions such as the content ratio of reacting materials, the polymerization reaction temperature, the reaction time, and the like.

For the modified resin used in the present invention, a number average molecular weight (Mn) thereof is in the range of about 1500 to about 100000, and preferably in the range of 2800 to 20000. A weight average molecular weight (Mw) thereof is in the range of about 2000 to about 100000, and preferably in the range of 5000 to 50000. A ratio of the weight average molecular weight to the number average molecular weight (Mw/Mn) is in the range of from about 1.1 to about 40, and preferably in the range of 3 to 30. A glass transition temperature thereof is in the range of from about 40° C. to about 90° C., and preferably in the range of 50° C. to 70° C. A softening point thereof is in the range of about 80° C. to about 150° C., and preferably in the range of 90° C. to 130° C.

In the toner of the present invention, at least a part of the wax release agent is embraced in the modified resin. In this case, "embrace" means that the wax release agent is selectively incorporated in the release polymer part of the modified resin because there is good compatibility between the release polymer part of the modified resin and the wax release agent.

The structure in which a wax release agent in embraced in the modified resin inside a toner can be observed in a following manner. A very thin slice of toner is formed using a cryo-microtome, the slice is dyed with ruthenium tetroxide, and then the slice is observed with a transmission electron microscope (TEM). Since the vinyl polymer part of the modified resin is dyed, it suggests that the release polymer part of the modified resin and the wax release agent are mutually dissolved.

A mold releasing wax content of the modified resin is about 33 parts by weight to about 1000 parts by weight, preferably 40 parts by weight to 250 parts by weight, and more preferably 50 parts by weight to 200 parts by weight, with respect to 100 parts by weight of the modified resin. Of all the wax contained in the toner, preferably 80% by weight or more, and more preferably 90% by weight or more is contained in the modified resin.

Unlike the conventional toner, the toner of the present invention doesn't occur the problems which are observed in the related art, even if the mold releasing wax is present in the vicinity of the toner particle surface. Thus the dispersion diameter of the wax can be made relatively large. As a result, the mold releasing agent of wax easily bleeds from the toner surface, and enhances the mold releasing effect.

As the dispersion diameter of the modified resin increases in the binder resin, the wax release agent becomes more easily incorporated in or adhered to the modified resin, and it also becomes easily expelled or detached from the toner surface. However, if the dispersion diameter of the modified resin in the resin increases too much, the dispersion diameter of the wax contained therein also tends to increase.

Regarding the dispersion diameter of the modified resin in the resin, a length of the long axis is preferably 0.1 μm to 2.5 μm, and more preferably 0.3 μm to 2.0 μm, and particularly preferably 0.3 μm to 1.5 μm. It is preferred that modified resin particles wherein the long axis longer than 2.5 μm, are not contained in the resin. Even if they are contained in the resin, a proportion of modified resin particles having a long axis longer than 2.5 μm is 1% by particle or less.

The dispersion diameter of the modified resin in the resin can be measured by an observation using a TEM.

The color toner of the present invention for forming images has a structure in which a modified resin is dispersed, undissolved, in a continuous phase of a resin which contains a urea-modified polyester resin. The continuous phase of a resin containing a urea-modified polyester resin is a binder resin which is incompatible with the modified resin.

The resin used in the present invention preferably has a component insoluble in tetrahydrofuran (THF). However, the modified resin is preferably soluble in THF. Resins which are typically used and which can easily develop glossiness do not include substantially any insoluble component, but the toner of the present invention can exhibit sufficient glossiness even if the toner contains an insoluble component due to its structure.

Preferably, a weight average molecular weight (Mw) of THF-soluble components of the binder resin by gel permeation chromatography (GPC) is from about 10000 to about 50000. It is possible to obtain a color toner having a suitable gloss by using a binder resin of the preferred molecular weight even if the binder resin contains insoluble components. Preferably, from the viewpoint of color reproducibility, that a glossiness of a full color image is about 10% or more. Conventionally, a toner which attains this glossiness has not contained a THF-insoluble component and therefore it has substantially been insoluble in THF. However, in the present invention, fixing at low temperature can be achieved while maintaining satisfactory hot offset properties by using a binder resin which contains a THF-insoluble component and has a weight average molecular weight (Mw) of about 50000 or less, and preferably 30000 or less. If the weight average molecular weight (Mw) of the binder resin is more than about 50000, the hot-offset properties of the toner obtained will be inadequate. The optimum amount of THF-insoluble components to obtain sufficient hot-offset properties and low temperature fixing properties simultaneously is in a range of from 5% to 30%. If the amount is less than 5%, the hot-offset properties will decline, and if it is more than 30%, the low temperature fixing properties will decline.

Measurements of THF-insoluble components in the present invention can be conducted in the following manner. To 1.0 g of toner, 50 g of THF are added and the mixture is kept at 20° C. for 24 hours. It is then filtered at room temperature using a 5C quantifying filter paper of the JIS standard (P3801). After drying, the residue of the filter paper is weighed to obtain the ratio of the toner to the filter paper residue (in percent by weight). Since the filter paper residue contains solid particles such as pigments; wax, if the wax is insoluble in THF; and other components, thermal analysis is conducted separately for quantification.

Further, the molecular weight of THF-soluble components can be obtained using GPC as follows. A column is stabilized in a heat chamber at 40° C. Then, THF is made to flow as a solvent through the column at the temperature and at a flowrate of 1 ml/min, and 200 μl of a THF sample solution of toner base which is prepared to have a concentration of from 0.05% by weight to 0.6% by weight of the toner is injected for the measurement. Prior to the injection, THF-insoluble components are removed from the THF sample solution by using a liquid chromatography filter of 0.45 μm. For measurements of molecular weights of toner samples, a molecular weight distribution of a sample is calculated using the calibration curve which is made from the relationship of molecular weights and count numbers of several different monodisperse polystyrene standards. In order to make a calibration curve, polystyrene standards available from Pressure Chemical Co. or Tosoh Corporation having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $6\times10^5$, $2\times10^6$, and $4.48\times10^6$ are used, and it is suitable to use at least 10 polystyrene standards. A refractive index detector is used for detection.

Preferably, in the color toner for electrophotography of the present invention which contains at least a binder resin, a release agent incompatible with the binder resin, and a colorant, a mixture of at least a portion of the binder resin and the colorant is kneaded with an organic solvent in advance. This allows the binder resin and the colorant to adhere to each other sufficiently at an early stage, which satisfies a condition of efficient dispersion, leading to good dispersion of the colorant in the binder resin and small dispersion diameter of the colorant, thus resulting in obtaining favorable transparency.

Various materials can be used as the binder resin that is kneaded with the colorant in addition to the modified and unmodified polyester resins mentioned above, for example, polymers of styrene or substituted styrenes such as polystyrene, poly p-chlorostyrene, polyvinyl toluene, and the like; styrene copolymers such as styrene-p-chlorostyrene copolymer, styrene-propylene copolymer, styrene-vinyltoluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, styrene-maleate copolymers, and the like; polymethylmethacrylate, polybutylmethacrylate, polyvinyl chloride, polyvinyl acetate, polyethylene, polypropylene, polyester, epoxy resins, epoxy polyol resins, polyurethanes, polyamides, polyvinyl butyral, polyacrylic resins, rosin, modified rosin, terpene resin, aliphatic or alicyclic hydrocarbon resins, aromatic petroleum resins, chlorinated paraffin, paraffin wax, and the like. These may be used either alone or in combination of two or more.

One method to knead the mixture of the binder resin and the colorant with an organic solvent in advance, for example, is to mix the binder resin, the colorant, and the organic solvent with a blender such as a Henschel mixer and then knead the mixture using a kneader of two-roll, three-roll, or the like at temperatures lower than the melting temperature of the binder resin so as to obtain a sample.

For the organic solvent, any typical organic solvent may be used with consideration to the solubility of the binder resin therein. However, acetone, toluene, butanone, and the like are preferable from the standpoint of the dispersiveness of the colorant. This manufacturing process not only reduces the particle diameters of colorant particles contained in a color toner to be obtained, but also increases the uniformity of the dispersed state of the particles and therefore further improves the color reproducibility of a projected image by an overhead projector. In addition, since the release agent, which is incompatible with the binder resin, is dispersed in the binder resin, the release agent is expelled from the surface of the toner at the time of fixing and therefore the toner has a sufficient anti-offset properties even if no oil is applied to a fixing member. If the release agent is compatible with the binder resin, this effect of expelling the release agent at fixing is diminished, increasing the likeliness of offset occurrence.

Colorants of the present invention preferably has a number average diameter of 0.5 μm or less, more preferably 0.4 μm or less, and still more preferably 0.3 μm or less.

If the number average diameter of the colorants is more than 0.5 μm, the dispersion properties of the pigment do not reach a sufficient level and therefore an aimed transparency cannot be attained even if a particular resin is used.

It is presumed that colorants having small particle diameters of 0.5 μm or less do not basically have an adverse effect on light reflectivity and absorption. Colorant particles of less than 0.1 μm contribute to good color reproducibility and good transparency of overhead projections having fixed images. On the other hand, if colorant particles larger than 0.5 μm exist in a large amount, there is an inevitable tendency that the brightness and color saturation of the projected images of the overhead projections decline.

Further, if colorant particles larger than 0.5 μm exist in a large amount, the colorant separates from the surface of the toner particles, which is likely to cause various problems such as fogging, drum contamination, and insufficient cleaning. In addition, when such toner is used in a double component developing agent, it will also cause problems such as carrier contamination and therefore it is difficult to obtain stable images with regards to durability to massive output. Subsequently, good color reproducibility cannot be expected, and uniform chargeability is hard to obtain.

The colorant used in the color toner of the present invention may be any pigment or dye known in the art which allows a yellow, magenta, cyan or black toner to be obtained. Examples of yellow pigments are cadmium yellow, mineral fast yellow, nickel titanium yellow, nebulous yellow, naphthol yellow S, Hanza yellow G, Hanza yellow 10G, benzidine yellow GR, quinoline yellow lake, permanent yellow NCG, tartrazine lake, and the like. Examples of orange pigments are molybdenum orange, permanent orange GTR, pyrazolone orange, Balkan orange, indanthrene brilliant orange RK, benzidine orange G, indanthrene brilliant orange GK, and the like.

Examples of red pigments are red iron oxide, cadmium red, permanent red 4R, Lithol Red, pyrazolone red, watching red calcium salt, Lake Red D, brilliant carmine 6B, eosin lake, rhodamine lake B, alizarin lake, brilliant carmine 3B, and the like.

Examples of purple pigments are fast violet B, methyl violet lake, and the like.

Examples of blue pigments are cobalt blue, alkali blue, Victoria blue lake, phthalocyanine blue, non-metal phthalocyanine blue, partial chloride phthalocyanine blue, fast sky blue, indanthrene blue BC, and the like.

Examples of green pigments are chrome green, chromium oxide, pigment green B, Malachite-Green lake, and the like.

Examples of black pigments are azine colorants such as carbon black, oil furnace black, channel black, lamp black, acetylene black and aniline black, metal salt azo colorants, metal oxides, oxidized metal compounds.

One, two or more of these colorants may be used.

(Dv/Dn (The ratio of weight average particle diameter to number average particle diameter))

The particle diameter of the toner of the present invention is not particularly limited, but from the standpoint of obtaining high quality images with thin-line reproducibility, a weight average particle diameter (Dv) of the toner particles is preferably from 2.5 μm to 8.0 μm, and more preferably from 3.0 μm to 7.0 μm. In addition, with a dry toner whose ratio of volume mean diameter to number mean diameter (Dn), Dv/Dn, is equal to or less than 1.25, more preferably from 1.10 to 1.25, the dry toner is excellent in all of anti-heat preservability, low-temperature fusibility, and hot offset resistance. In addition, when used in a full-color copier, images have excellent gloss. Moreover, in a double component developing agent, the fluctuation of toner particle diameter in the developing agent is reduced even after the adjustment of toner particle concentration is carried out for a long period of time, and good and stable development is achieved after a long term agitation by a developing device. In addition, when used as a single component developing agent, the fluctuation of toner particle diameter is reduced even if adjustment of toner concentration is conducted, and there is no filming of toner to developing roller and no adhesion of molten toner to members such as a blade for making a thin layer of toner. Furthermore, good and stable development is achieved and quality images are obtained even after a long term use (agitation) of a developing device.

It is said that generally, the smaller that the diameters of toner particles are, the more advantageous it is to obtain high resolution and high quality images. However, it is, on the contrary, disadvantageous with regards to transferability and cleanability. Moreover, if the volume mean diameter is less than the preferred range of the present invention, in a double component developing agent, molten toner particles adhere to the surface of carrier particles after a long term agitation in an image-developer device, degrading the charge performance of the carrier particles. When used as a single component developing agent, filming of toner to developing roller and adhesion of molten toner to members such as a blade for making a thin layer of toner are more likely to occur.

These phenomena are also observed for a toner that has higher ratio of small toner particles therein than the preferred range of the present invention (i.e. Dv/Dn>1.25). On the other hand, if the diameter of toner particles is larger than the preferred range of the present invention, it becomes difficult to obtain high resolution and high quality images, and in many cases the fluctuation of toner particle diameters is larger when the toner concentration in a developing agent is adjusted. In addition, it has been discovered that the same applies for a case when the ratio Dv/Dn is larger than 1.25.

(Urea-modified Polyester)

The color toner of the present invention for forming images contains a urea-modified polyester as a binder resin.

Examples of the urea-modified polyester resin (i) are the reaction product of a polyester prepolymer (A) which contains an isocyanate group, an amine (B), and the like. The polyester prepolymer which contains an isocyanate group (A) may be obtained by taking a polyester which is a condensation polymer of a polyol (1) and polycarboxylic acid (2), and which contains an active hydrogen group, and further reacting it with a polyisocyanate (3). Examples of the active hydrogen group in the above-mentioned polyester are a hydroxyl group (an alcoholic hydroxyl group and a phenolic hydroxyl group), an amino group, a carboxyl group, a sulfhydryl group, and the like. Of these, an alcoholic hydroxyl group is preferred.

Polyols (1) include diol (1-1) and polyols having three or more hydroxyl groups (1-2), and it is preferable to use (1-1) alone, or a mixture of (1-1) and a small amount of (1-2). Diols (1-1) include alkylene glycols (ethylene glycol, 1,2-propylene glycol, 1,3-propylene glycol, 1,4-butane diol, 1,6-hexane diol, and the like); alkylene ether glycols (diethylene glycol, triethylene glycol, dipropylene glycol, polyethylene glycol, polypropylene glycol polytetramethylene ether glycol, and the like); alicyclic diols (1,4-cyclohexane dimethanol, hydrogenated bisphenol A, and the like); bisphenols (bisphenol A, bisphenol F, bisphenol S, and the like); adducts of alicyclic diols with alkylene oxides (ethylene oxide, propylene oxide, butylene oxide, and the like); adducts of bisphenols with alkylene oxides (ethylene oxide, propylene oxide, butylene oxide, and the like); and the like. Among these, alkylene glycols having 2 to 12 carbon atoms and adducts of bisphenols with alkylene oxides are preferred, and particularly preferred are adducts of bisphenols with alkylene oxides and a mixture thereof with alkylene glycols having 2 to 12 carbon atoms. Polyols having three or more hydroxyl groups (1-2) include polyhydric aliphatic alcohols having 3 to 8 hydroxyl groups (glycerin, trimethylolethane, trimethylolpropane, pentaerythritol, sorbitol, and the like); polyhydric phenols having 3 or more hydroxyl groups (trisphenol PA, phenol novolac, cresol novolac, and the like); adducts of polyhydric phenols having 3 or more hydroxyl groups with alkylene oxides; and the like.

Polycarboxylic acids (2) include dicarboxylic acids (2-1), polycarboxylic acids having 3 or more hydroxyl groups (2-2), and the like, and it is preferable to use (2-1) alone, or a mixture of (2-1) and a small amount of (2-2). Dicarboxylic acids (2-1) include alkylene dicarboxylic acids (succinic acid, adipic acid, sebacic acid, and the like); alkenylene dicarboxylic acids (maleic acid, fumaric acid, and the like); aromatic dicarboxylic acids (phthalic acid, isophthalic acid, terephthalic acid, naphthalene dicarboxylic acid, and the like); and the like. Among these, alkenylene dicarboxylic acids having 4 to 20 carbon atoms and aromatic dicarboxylic acids having 8 to 20 carbon atoms are preferable. Polycarboxylic acids having 3 or more hydroxyl groups (2-2) include aromatic polycarboxylic acids having 9 to 20 carbon atoms (trimellitic acid, pyromellitic acid, and the like) and the like. It is of note that polycarboxylic acids (2) may be replaced with an acid anhydride or a lower alkyl ester (methyl ester, ethyl ester, isopropyl ester, or the like) of the above-described carboxylic acids to be reacted with polyols (1).

The ratio of a polyol (1) to a polycarboxylic acid (2), by the equivalent ratio of hydroxyl groups (OH) to carboxyl groups (COOH), which is [OH]/[COOH], is typically 2/1 to 1/1, preferably 1.5/1 to 1/1, more preferably 1.3/1 to 1.02/1.

Polyisocyanates (3) include aliphatic polyisocyanates (tetramethylene diisocyanate, hexamethylene diisocyanate, 2,6-diisocyanate methylcaproate, and the like); alicyclic polyisocyanates (isophorone diisocyanate, cyclohexylmethane diisocyanate, and the like); aromatic diisocyanates (tolylene diisocyanate, diphenylmethane diisocyanate, and the like); aromatic aliphatic diisocyanates (α,α,α',α'-tetramethylxylene diisocyanate and the like); isocyanurates; above-mentioned polyisocyanates blocked with a phenol derivative, an oxime, caprolactum, or the like; and combinations of two or more of these.

The ratio of a polyisocyanate (3), by the equivalent ratio of isocyanate groups (NCO) to hydroxyl groups (OH) of the polyester, [NCO]/[OH], is typically 5/1 to 1/1, preferably 4/1 to 1.2/1, more preferably 2.5/1 to 1.5/1. When the ratio [NCO]/[OH] is more than 5, low-temperature fusibility is degraded. When the molar ratio of [NCO] is less that 1, the amount of urea in the modified polyester is low and thus adversely affect hot offset resistance. The amount of polyisocyanate (3) component in an isocyanate group-containing prepolymer (A) is typically 0.5% by weight to 40% by weight, preferably 1% by weight to 30% by weight, more preferably 2% by weight to 20% by weight. If the amount is less than 0.5% by weight, hot offset resistance is lowered and it is disadvantageous with regards to satisfying anti-heat preservability and low-temperature fusibility at the same time. If the amount is more than 40% by weight, low-temperature fusibility is reduced.

The number of isocyanate groups contained for each molecule of isocyanate group-containing prepolymer (A) is typically 1 or more, preferably 1.5 to 3 in average, more preferably 1.8 to 2.5 in average. If it is less than 1 per molecule, the molecular weight of the modified polyester after cross-linking and/or elongation is reduced and therefore hot offset resistance is degraded.

Amines (B) include diamines (B1), polyamines having 3 or more amino groups (B2), amino alcohols (B3), amino mercaptans (B4), amino acids (B5), derivatives of B1 to B5 in which the amino groups are blocked (B6), and the like. Diamines (B1) include aromatic diamines (phenylene diamine, diethyltoluene diamine, 4,4'-diaminodiphenylmethane, and the like); alicyclic diamines (4,4'-diamino- 3,3'-dimethyldicyclohexylmethane, diaminocyclohexane, isophoronediamine, and the like); aliphatic diamines (ethylenediamine, tetramethylenediamine, hexamethylenediamine, and the like); and the like. Polyamines having 3 or more amino groups (B2) include diethylenetriamine, triethylenetetramine, and the like. Amino alcohols (B3) include ethanolamine, hydroxyethylaniline, and the like. Amino mercaptans (B4) include aminoethyl mercaptan, aminopropyl mercaptan, and the like. Amino acids (B5) include amino propionic acid, amino caproic acid, and the like. Derivatives of B1 to B5 in which the amino groups are blocked (B6) include ketimine compounds and oxazoline compounds that are obtained from amines of B1 to B5 and ketones. (acetone, methylethylketone, methylisobutylketone, and the like), and other compounds. Among these amines (B), B1 and a mixture of B1 and a small amount of B2 are preferable.

Additionally, an elongation inhibitor can be used, if necessary, to adjust the molecular weight of the urea-modified polyester. Examples of the inhibitor include monoamines (diethylamine, dibutylamine, butylamine, laurylamine, and the like), those that are blocked (ketimine compounds), and the like.

The ratio of amines (B) by the equivalent ratio of isocyanate groups (NCO) in the isocyanate group-containing prepolymer (A) to amino groups (NHx) in the amine (B), [NCO]/[NHx], is typically 1/2 to 2/1, preferably 1.5/1 to 1/1.5, more preferably 1.2/1 to 1/1.2. If the ratio [NCO]/[NHx] is more than 2 or less than 1/2, the molecular weight of the modified polyester will be low and its hot offset resistance will be degraded. In the present invention, the modified polyester resin (i) modified by urea bonds may contain urethane bonds together with urea bonds. The molar ratio of a content of the urea bonds to a content of the urethane bonds is usually 100/0 to 10/90, is preferably 80/20 to 20/80, and is more preferably 60/40 to 30/70. If the molar ratio of the urea bonds is less than 10%, hot offset-resistance properties deteriorate.

The urea-modified polyester resin (i) of the present invention may be manufactured by the one-shot method or the prepolymer method. The weight average molecular weight of the urea-modified polyester resin (i) is usually 10000 or more, is preferably 20000 to 10 million and is more preferably 30000 to 1 million. If it is less than 10000, hot offset-resistance properties deteriorate. The number average molecular weight of the urea-modified polyester resin (i) is not particularly limited when used together with the non-modified polyester resin (ii), as described later, and may be the number average molecular weight at which the aforesaid weight average molecular weight can be easily obtained. When the urea-modified polyester resin (i) is used alone, the number average molecular weight is usually 20000 or less, is preferably 1000 to 10000, and is more preferably 2000 to 8000. If the number average molecular weight is more than 20000, low temperature image-fixing properties and glossiness when used in full color image-forming apparatuses deteriorate.

(Unmodified Polyester)

For the present invention, the urea bond-modified polyester (i) can be used alone, but it is also possible to use unmodified polyester (ii) included as a toner binder component in addition to (i). By using (ii) with (i), low-temperature fusibility and the glossiness of images when used in a full-color device are improved and therefore it is preferable. Examples of (ii) include the same polyester components of (i), which are condensation polymerization products of polyols (1) and polycarboxylic acids (2), and preferred examples are also the same as those of (i). In addition to an unmodified polyester, (ii) can also be a polyester modified by a chemical bond other than a urea bond, for example, a urethane bond. It is preferable from the standpoint of low-temperature fusibility and hot offset resistance that (i) and (ii) form a mixture that is compatible at least in a portion thereof. Therefore, it is preferred that the polyester component of (i) and (ii) have similar compositions. In the mixture, the weight ratio of (i) to (ii) is typically 5/95 to 80/20, preferably 5/95 to 30/70, more preferably 5/95 to 25/75, and particularly preferably 7/93 to 20/80. When the weight ratio of (i) is less than 5%, hot offset resistance is degraded, and it is disadvantageous with regards to satisfying anti-heat preservability and low-temperature fusibility at the same time.

The peak molecular weight of (ii) is usually 1000 to 20000, preferably 1500 to 10000, and more preferably 2000 to 8000. If it is less than 1000, heat-resistant storage properties deteriorate. If it is more than 10000, low temperature image-fixing properties deteriorate. The hydroxyl value of (ii) is preferably 5 or more, more preferably 10 to 120, and still more preferably 20 to 80. If it is less than 5, it is disadvantageous from the viewpoint of obtaining both heat-resistant storage properties and low temperature image-fixing properties at the same time. The acid value of (ii) is usually 1 to 30, preferably 5 to 20. By giving the acid value, a negative electrostatic charge can be easily acquired.

In the present invention, the glass transition temperature (Tg) of the toner binder is usually 50° C. to 70° C., and preferably 55° C. to 65° C. If the glass transition temperature (Tg) is less than 50° C., blocking worsens when the toner is stored at high temperatures. If it is more than 70° C., low temperature image-fixing properties of the toner is insufficient. In a dry toner of the present invention, due to the presence of the urea-modified polyester resin, heat-resistant storage properties tend to be good, compared to polyester toners known in the art, even if the glass transition temperature is low. The temperature (TG') at which the storage elasticity modulus of the toner binder is 10000 dyne/cm$^2$ at a measurement frequency of 20 Hz, is usually 100° C. or higher, and is preferably 110° C. to 200° C. If it is less than 100° C., hot offset-resistance properties deteriorate. The temperature (Tη) at which the viscosity of the binder resin of the toner is 1000 poises at a frequency of 20 Hz, is usually 180° C. or less, and is preferably 90° C. to 160° C. If it is more than 180° C., low temperature image-fixing properties deteriorate. Specifically, from the viewpoint of obtaining both low temperature image-fixing properties and hot offset-resistance properties at the same time, TG' is preferably higher than Tη. In other words, the difference (TG'−Tη) of TG' and Tη is preferably 0° C. or more. It is more preferably 10° C. or more, and is still more preferably 20° C. or more. There is no particular restriction as to the upper limit. From the viewpoint of obtaining both heat-resistant storage properties and low temperature image-fixing properties at the same time, the difference of Tη and Tg is preferably 0° C. to 100° C., is more preferably 10° C. to 90° C. and still more preferably 20° C. to 80° C.

(Release Agent)

Further, the color toner on the present invention for forming images contains a release agent in addition to a toner binder and a colorant. Preferably, the release agent is wax. The release agent wax of the present invention may be any of those known in the art. Examples of the wax are polyolefin wax (polyethylene wax, polypropylene wax, or the like); a long chain hydrocarbon (paraffin wax, Sasol wax, or the like); a carbonyl group-containing wax, and the like. Of these, the carbonyl group-containing wax is preferred. Examples of the carbonyl group-containing wax is polyalkane acid esters (carnauba wax, montan wax, trimethyloylpropane tribehenate, pentaerythrytol tetrabehenate, pentaerythrytol diacetate dibehenate, glyceryl tribehenate, 1,18-octadecanediol distearate, or the like); polyalkenol esters (trimellitic acid tristearyl, distearyl maleate, or the like); polyalkane acid amides (ethylenediamine dibehenylamide, or the like); polyalkylamides (trimellitic tristearylamides, or the like); dialkyl ketones (distearylketone, or the like), and the like. Of the carbonyl group-containing wax, the polyalkane acid esters are preferred.

In the present invention, ester wax, free fatty acid eliminated carnauba wax, montan wax and oxidized rice wax may be used alone or in combination. The ester wax having a branched structure is particularly superior in releasing effects, and it may be preferably used. The carnauba wax is preferably microcrystalline, and has an acid value of about 5 or less. Moreover a particle diameter of the carnauba wax is about 1 μm or less when it is dispersed in the toner binder. For montan wax, this generally refers to montan wax refined from minerals. As is the case with carnauba wax, it is preferred to be microcrystalline and have an acid value of about 5 to about 14. Oxidized rice wax is prepared by the air oxidation of rice bran wax, and its acid value is preferably 10 to 30. If the acid value of these waxes is less than the corresponding ranges, the temperature of low temperature fixing rises and low temperature fixing properties are insufficient. Conversely, if the acid value is more than these ranges, the cold offset temperature may rise and low temperature fixing properties may be insufficient. A wax content of the toner is about 1 part by weight to about 15 parts by weight, and preferably 3 parts by weight to 10 parts by weight, with respect to 100 parts by weight of the whole resin content of the toner. If the wax content is less than about 1 part by weight, a releasing effect may become insufficient so that a desired effect is difficult to obtain. If the wax content is more than about 15 parts by weight, problems may occur such as a consumption of the toner to carrier becoming excessive.

The term "wax content of the toner" means the total amount of the release agent wax added during the toner manufacturing process and the wax that is contained as a release polymer as a portion of the graft polymer resin (the modified resin). In addition, 100 parts by weight of the resin in the toner includes not only the binder resin added during the toner manufacturing process, but also the modified resin and the vinyl polymer resin contained in the modified resin.

The melting point of the wax used in the present invention is usually 40° C. to 160° C., is preferably 50° C. to 120° C. and is more preferably 60° C. to 90° C. If the melting point of the wax is less than 40° C., there is an adverse effect on heat resistance storage properties. If the melting point of the wax is more than 160° C., cold offset during image-fixing tends to occur at low temperature. Further, the melting viscosity of the wax is preferably 5 cps to 1000 cps, is more preferably 10 cps to 100 cps, which is the value measured at a temperature 20° C. higher than the melting point. If the melting viscosity of the wax is more than 1000 cps, there is not much improvement of hot offset-resistance properties and low temperature image-fixing properties. The content of the wax in the toner is usually 0% by weight to 40% by weight, and is preferably 3% by weight to 30% by weight.

(Charge Control Agent)

The toner of the present invention may further contain a charge control agent if necessary. It is preferable to use the material which is or nearly colorless or white since the color of the toner will change if a colored material is used. Any of the charge control agents known in the art may be used. Examples of the charge control agent are triphenylmethane dyes, molybdic acid chelate dyes, rhodamine dyes, alkoxy amines, quaternary ammonium salts (including fluorinated quaternary ammonium salts), alkyl amides, phosphorus or its compounds, tungsten or its compounds, fluorine activating agents, salicylic acid metal complexes, metal salts of salicylic acid derivatives, and the like. Specific examples are Bontron P-51 as the quaternary ammonium salt, oxynaphthoic acid metal complex E-82, the salicylic acid metal complex E-84, the phenolic condensate E-89 (available from Orient Chemical Industries), the quaternary ammonium salt molybdenum complexes TP-302, TP-415 (available from Hodogaya Chemical Industries), the quaternary ammonium salt Copy Charge PSY VP2038, the triphenylmethane derivative Copy Blue PR, the quaternary ammonium salt Copy Charge NEG VP2036, the Copy Charge NX VP434 (available from Hoechst), LRA-901, LR-147 as the boron complex (available from Japan Carlit Co., Ltd.), quinacridone, azo pigments and other polymer compounds containing a functional groups such as sulfonic acid group, carboxylic acid group, quaternary ammonium salt, or the like.

The amount of the charge control agent in the present invention is determined according to the type of the binder resin and modified resin, the presence or absence of additives which may be used if necessary, and the process for manufacturing the toner including the dispersion method. Although this is not a universal limitation, the amount of the charge control agent may be 0.1 part by weight to 10 parts by weight relative to 100 parts by weight of the resin in the toner. It is preferred that the amount of the charge control agent is 0.2 parts by weight to 5 parts by weight. If it is more than 10 parts by weight, the charge amount for the toner is excessively large, the effect of the main charge control agent is diminished, the electrostatic attraction with the development roller increases, and this therefore leads to a deterioration in fluidity of the developer and decrease of image density. These charge control agents may be melt kneaded and then dissolved or dispersed together with the resin, may of course be added upon dissolution or dispersion in an organic solvent, and may be fixed onto the surface of the toner particles after forming them.

(Resin Particulates)

In the present invention, it is possible to add resin particulates to the toner. Any resin, including thermoplastic resins and thermosetting resins, may be used for the resin particulates provided that the resin is capable of forming an aqueous dispersion. Examples include vinyl resins, polyurethane resins, epoxy resins, polyester resins, polyamide resins, polyimide resins, silicone resins, phenol resins, melamine resins, urea resins, aniline resins, ionomer resins, polycarbonate resins, and the like. Two or more of these resins may be used in combination for the resin particulates. Among these, from the standpoint of the ease of obtaining an aqueous dispersion of micro-spherical resin particles, vinyl resin, polyurethane resins, epoxy resins, polyester resins, combinations thereof are preferable.

Examples of vinyl resins include homopolymers and copolymers of vinyl monomers, such as styrene-(meth) acrylate resin, styrene-butadiene copolymer, (meth)acrylic acid-acrylate polymer, styrene-acrylonitrile copolymer, styrene-maleic anhydride copolymer, styrene-(meth)acrylic acid copolymer, and the like.

(External Additive)

Inorganic particulates can preferably be used as the external additive which supplements the fluidity, developing properties, and charging properties of the colored particle of the present invention. The primary particle diameter of the inorganic particulates is preferably 5 nm to 2 $\mu$m, more preferably 5 nm to 500 nm. The specific surface area measured by the BET method is preferably 20 $m^2/g$ to 500 $m^2/g$. The amount of the inorganic particulates in a toner is preferably 0.01% by weight to 5% by weight of the toner, more preferably 0.01% by weight to 2.0% by weight. Specific examples of the inorganic particulates include silica, alumina, titanium oxide, barium titanate, magnesium titanate, calcium titanate, strontium titanate, zinc oxide, tin oxide, silica sand, clay, mica, silicic pyroclastic rock, diatomite, chromium oxide, cerium oxide, red iron oxide, antimony trioxide, magnesium oxide, zirconium oxide, barium sulfate, barium carbonate, calcium carbonate, silicon carbide, silicon nitride, and the like.

In addition, the examples include polymer particulates obtained by, for example, soap-free emulsion polymerization, suspension polymerization, or dispersion polymerization, such as polystyrene, methacrylate, and acrylate copolymers, and the like; condensation polymers such as silicone, benzoguanamine, nylon, or the like; polymer particles of thermosetting resins; and the like.

These fluidity enhancers (inorganic particulates) can be surface-treated to increase hydrophobicity so that they can prevent loss of fluidity and chargeability even under high humidity. Examples of suitable surface treatment agents include silane coupling agents, silylating agents, silane coupling agents having a fluorinated alkyl group, organic titanate coupling agents, aluminum coupling agents, silicone oil, modified silicone oil, and the like.

A cleanability improving agent that helps remove the developing agent remaining on a photoconductor or a primary transfer medium after transfer can be added to a toner. Examples of the cleaneability improving agent include fatty acid metal salts such as zinc stearate, calcium stearate, stearic acid, and the like; polymer particulates manufactured by soap-free emulsion polymerization or the like such as polymethylmethacrylate particulates, polystyrene particulates; and the like. The polymer particulates preferably have a relatively narrow particle size distribution, and a volume mean particle diameter of 0.01 $\mu$m to 1 $\mu$m.

(Process of Manufacturing)

The color toner of the present invention for forming images can be obtained by emulsifying and suspending an organic solvent containing at least a modified polyester resin capable of forming a urea bond in an aqueous medium under the existence of a modified resin and release agent, and allowing the mixture to react in addition polymerization, and removing the organic solvent, and the washing.

The modified polyester resin capable of forming a urea bond may be, for example, manufactured by the following process. A polyol (1) and polycarboxylic acid (2) are heated to 150° C. to 280° C. in the presence of an esterification catalyst known in the art such as a tetrabutoxy titanate, dibutyl tin oxide, or the like.

Next, the water produced in the reaction is distilled off under reduced pressure if necessary, and a polyester that contains hydroxyl groups is thereby obtained. Thereafter, the polyisocyanate (3) is reacted with the polyester at 40° C. to 140° C. so as to obtain the prepolymer (A) that contains isocyanate groups. This is the modified polyester resin capable of forming a urea bond. The amine (B) is then reacted with this prepolymer (A) at 0° C. to 140° C. in order to obtain the urea bond-modified polyester. When the polyisocyanate (3) is reacted, and when (A) is reacted with (B), a solvent may also be used, if necessary. Examples of solvents which can be used. are compounds that are inert with respect to the isocyanate (3). The examples include aromatic solvents (toluene, xylene, or the like); ketones (acetone, methyl ethyl ketone, methyl isobutyl ketone, or the like); esters (ethyl acetate, or the like); amides (dimethyl formamide, dimethyl acetamide, or the like), ethers (tetrahydrofuran, or the like.), and the like. When the non-modified polyester resin (ii) which is not modified by urea bonds is used in manufacturing the toner as well, the non-modified polyester resin (ii) is manufactured by an identical process to that used for a polyester which contains hydroxyl groups, and is then dissolved in the solvent after completion of the reaction for manufacturing (i).

The dry toner of the present invention can be manufactured by the following process. Maufacturing methods are not limited to the below process, however.

(Process for Manufacturing the Toner in Aqueous Medium)

The modified polyester resin capable of forming a urea bond can be used to obtain the toner of the present invention by emulsifying and suspending the modified polyester resin in an aqueous medium under the existence of a modified resin and release agent, allowing it to react in addition polymerization, removing the organic solvent, and washing.

The aqueous medium used in the present invention may be water used alone, or water used together with a miscible solvent. Examples of such miscible solvents are alcohols (methanol, isopropanol, ethylene glycol, or the like), dimethylformamide, tetrahydrofuran, cellusolves (methyl cellusolve, or the like.), lower ketones (acetone, methyl ethyl ketone, or the like), and the like.

The particles of the toner may be formed by reacting a dispersant comprising a prepolymer (A) having isocyanate groups with amines (B) in the aqueous medium, or the urea-modified polyester (i) manufactured previously, may be used. One of the processes for stably forming the dispersant comprising the urea-modified polyester (i) or prepolymer (A) in an aqueous medium, is to add a toner initial material composition comprising the urea-modified polyester (i) or prepolymer (A) to the aqueous medium, and disperse it by shear force. The prepolymer (A) and other toner components (hereafter, referred to as toner initial materials) such as a modified resin, release agent, coloring agent, coloring agent masterbatch, charge control agent, other resins such as non-modified polyester resin, and the like may be added when the dispersant is formed in the aqueous medium. It is preferred to first mix the toner initial materials, optionally with prepolymer (A), together, and then disperse this mixture in the aqueous medium. It is particularly preferable to mix an organic solvent in which a modified resin and release agent are dissolved and the prepolymer (A), and then take the mixture to emulsify and suspend in the aqueous medium. Further, according to the present invention, it is not absolutely necessary to add toner initial materials such as a coloring agent, charge control substance, and the like, when the particles are formed in the aqueous medium, and they may be added after the particles have been formed. For example, after forming particles which do not contain a coloring agent, a coloring agent can be added by a dyeing method known in the art.

There is no particular limitation on the dispersion method which may employ any dispersion apparatus known in the art such as low speed shear, high speed shear, friction, high-pressure jet, ultrasound, or the like. To obtain dispersant particles having diameters of 2 μm to 20 μm, the high speed shear is preferred. When a high speed shear dispersion apparatus is used, there is no particular limitation on the rotation speed, which is usually 1000 rpm to 30000 rpm, and is preferably 5000 rpm to 20000 rpm. There is no particular limitation on the dispersion time, but in the case of a batch process, this is usually 0.1 minute to 5 minutes. The temperature in the dispersion is usually 0° C. to 150° C. (under pressure), and is preferably 40° C. to 98° C. If a higher temperature is used, the viscosity of the dispersant comprising the urea-modified polyester (i) or prepolymer (A) is lower, and dispersing is easier, which is desirable.

The amount of the aqueous medium relative to 100 parts by weight of the toner composition comprising the urea-modified polyester (i) or prepolymer (A) is usually 50 parts by weight to 2000 parts by weight, and is preferably 100 parts by weight to 1000 parts by weight. If it is less than 50 parts by weight, the dispersion state of the toner composition is poor, and particles having the predetermined particle diameters are not obtained. If it is more than 2000 parts by weight, it is not economical. A dispersion agent can also be added if necessary. The use of a dispersion agent makes the particle diameter distribution sharp and stabilizes the dispersion, and is therefore desirable.

In order to synthesize the urea-modified polyester (i) from the prepolymer (A), amines (B) may be added before dispersing in the aqueous medium, or it may be added after dispersing the medium so as to initiate reaction from the interface of the particles. In this case, the urea-modified polyester primarily forms at the surface of the toner being obtaind, and it is possible to make a concentration gradient inside the particles.

Examples of dispersion agents which can be used to emulsify and disperse the oil phase in which the toner composition is dispersed, in a liquid containing water, are anionic surfactants such as alkyl benzene sulfonates, α-olefin sulfonates, phosphoric acid esters, or the like; amine salts such as alkylamine salts, aminoalcohol fatty acid derivatives, polyamine fatty acid derivatives, imidazoline, or the like; quaternary ammonium salt cationic surfactants such as alkyltrimethyl ammonium salts, dialkydrimethyl ammonium salts, alkyl dimethyl benzyl ammonium salts, pyridinium salts, alkyl isoquinolinium salts, benzetonium chloride, or the like; non-ionic surfactants such as fatty acid amide derivatives, polyvalent alcohol derivatives, or the like; amphoteric surfactants such as aniline, dodecyldi(aminoethyl)glycine, di(octylaminoethyl)glycine, N-alkyl-N,N-dimethylammoniumbetaine, or the like; and the like.

By using a surfactant having a fluoroalkyl group, an effect can be obtained with an extremely small amount of the surfactant. Examples of anionic surfactants having a fluoroalkyl group which can be conveniently be used are fluoroalkyl carboxylic acids having 2–10 carbon atoms and metal salts thereof, disodium perfluorooctane sulfonylglutamate, sodium 3-[omega-fluoroalkyl (C6 to C11) oxy]-1-alkyl (C3 to C4) sulfonate, sodium 3-[omega-fluoroalkanoyl (C6 to C8)-N-ethylamino]-1-propane sulfonate, fluoroalkyl (C11 to C20) carboxylic acids and metal salts thereof, perfluoroalkyl carboxylic acids (C7 to C13) and metal salts thereof, perfluoroalkyl (C4 to C12) sulfonates and metal salts thereof, perfluorooctanesulfonic acid diethanolamide, N-propyl-N-(2-hydroxyethyl) perfluorooctane sulfonamide, perfluoroalkyl (C6 to C10) sulfonamide propyltrimethylammonium salt, perfluoroalkyl (C6 to C10)-N-ethylsulfonyl glycine salt, monoperfluoroalkyl (C6 to C16) ethyl phosphoric acid ester, and the like.

Examples of the commercial products are Surflon S-111, Surflon S-112, Surflon S-113 (available from Asahi Glass Co., Ltd.), Fluorad FC-93, Fluorad FC-95, Fluorad FC-98, Fluorad FC-129 (available from Sumitomo 3M, Co., Ltd.), Unidyne DS-101, DS-102 (available from Daikin Industries, Ltd.), Megaface F-110, Megaface F-120, Megaface F-113, Megaface F-191, Megaface F-812, Megaface F-833 (available from Dainippon Ink and Chemicals Incorporated), Eftop EF-102, EF-103, EF-104, EF-105, EF-112, EF-123A, EF-123B, EF-306A, EF-501, EF-201, EF-204 (available from JEMCO Inc.), FTERGENT F-100, FTERGENT F-150 (available from NEOS), and the like.

Examples of cationic surfactants are primary, secondary or tertiary amines having a fluoroalkyl group, quaternary ammonium salts of fatty acids such as perfluoroalkyl (C6 to C10) sulfonamide propyltrimethylammonium salt, or the like; benzalkonium salts, benzetonium chloride, pyridinium chloride and imidazolinium salts, examples of commercial products being Surflon S-121 (available from Asahi Glass Co., Ltd.), Fluorad FC-135 (available from Sumitomo 3M). Unidyne DS-202 (available from Daikin Industries, Ltd.), Megaface F-150, Megaface F-824 (available from Dainippon Ink and Chemicals Incorporated), Eftop EF-132 (available from JEMCO Inc.), FTERGENT F-300 (available from NEOS), and the like.

Inorganic compound dispersing agents insoluble in water such as tricalcium phosphate, calcium carbonate, titanium oxide, colloidal silica, hydroxyapatite, or the like can also be used. The dispersion droplets may also be stabilized by a polymer protecting colloid. Examples are acids such as acrylic acid, methacrylic acid, α-cyanoacrylic acid, α-cyanomethacrylic acid, itaconic acid, crotonic acid, fumaric acid, maleic acid, maleic anhydride, or the like; (meth)acrylic monomers which contain hydroxyl groups such as β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro-2-hydroxypropyl methacrylic acid, diethylene glycol monoacrylic acid ester, diethylene glycol monomethacrylic acid ester, glycerine monoacrylic acid ester, glycerine monomethacrylic acid ester, N-methyloylacrylamide, N-methyloylmethacrylamide, or the like; vinyl alcohol or ether of vinyl alcohol such as vinyl methyl ether, vinyl ethyl ether and vinyl propyl ether, esters of compounds containing a carboxylic group with vinyl alcohol such as vinyl acetate, vinyl propionate and vinyl butyrate, acrylamide, methacrylamide, diacetone acrylamide, methyloyl compounds thereof, or the like; acid chlorides such as acrylic acid chloride and methacrylic acid chloride, homopolymers and copolymers containing a nitrogen atom or its heterocyclic ring such as vinyl pyridine, vinyl pyrrolidine, vinyl imidazole, ethyleneimine, or the like; polyoxyethylene compounds such as polyoxthylene, polyoxypropylene, polyoxyethylene alkylamine, polyoxyethylene propylamine, polyoxyethylene alkylamide, polyoxypropylene alkylamide, polyoxyethylene nonyl phenyl ether, polyoxyethylene lauryl phenyl ether, polyoxyethylene stearyl phenyl ether, polyoxyethylene nonyl phenyl ester, or the like; celluloses such as methyl cellulose, hydoxyethyl cellulose, hydroxypropyl cellulose, or the like; and the like.

If a substance such as calcium phosphate which is soluble in acid or alkali is used as a dispersion stabilizer, the calcium phosphate or other substance is dissolved using acid such as hydrochloric acid, or the like, and calcium phosphate is then removed from the particles by rinsing with water. It may also be removed by enzymatic decomposition.

If a dispersant is used, the dispersant may be left on the surface of the toner. From the viewpoint of charging toner, it is preferred to remove it by performing at least one of an extension and crosslinking reaction, and washing.

In order to reduce the viscosity of the toner composition, a solvent may be used. The urea-modified polyester (i) or prepolymer (A) is soluble in the solvent. The use of the solvent is preferred from the viewpoint that the particle size distribution is sharp. This solvent is preferably volatile and has a boiling point of less than 100° C. from the viewpoint of easy removal. Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, and the like. One of these solvents can be used either alone or in combination of two or more. In particular, aromatic solvents such as toluene, xylene, or the like and halogenated hydrocarbons such as methylene chloride, 1,2-dichloroethane, chloroform, carbon tetrachloride, or the like are preferred. The amount of the solvent to be used is usually 0 part by weight to 300 parts by weight, is preferably 0 part by weight to 100 parts by weight, and is more preferably 25 parts by weight to 70 parts by weight relative to 100 parts by weight of the prepolymer (A). If the solvent is used, at least one of an extension and crosslinking reaction, is performed, and the solvent is then removed by heating at normal pressure or under reduced pressure.

Reaction time for at least one of the extension and crosslinking is selected according to the reactivity of the combination of the isocyanate group in the prepolymer (A) and the amine (B), and it is usually 10 minutes to 40 hours, and is preferably 2 hours to 24 hours. The reaction temperature is usually 0° C. to 150° C., and is preferably 40° C. to 98° C. A catalyst known in the art may also be used if required. Specific examples are dibutyl tin laurate, dioctyl tin laurate, and the like.

To remove the organic solvent from the obtained emulsification dispersant, the temperature of the whole system is gradually raised, and the organic solvent in the liquid drops is completely removed by evaporation. Alternatively, the emulsification dispersant is sprayed into a dry atmosphere to completely remove the water-insoluble organic solvent in the liquid drops and form toners, and aqueous dispersing agent is removed at the same time by evaporation. The dry atmosphere into which the emulsification dispersant is sprayed, is generally a heated gas such as air, nitrogen, carbon dioxide or combustion gas, the gas flow being heated to a temperature above the boiling point of the highest-boiling solvent used. The desired product quality can be obtained in a short time by using a spray dryer, belt dryer, rotary kiln, or the like.

If the particle size distribution during emulsification dispersion is large, and washing or drying are performed while maintaining this particle size distribution, the particle size distribution can be adjusted to a desired particle size distribution by classification. The classification is performed by removing particles from the liquid using a cyclone, decanter, centrifugal separation, or the like. The classifying can naturally be performed after obtaining the dry powder. It is preferred from the viewpoint of efficiency to perform this in the liquid. The unnecessary toner particles, either too small or too large, can be recycled to the melt-kneading step to form new toner particles. In that case, the unnecessary toner particles may be wet. It is preferred that the dispersing agent is removed from the obtained dispersion as much as possible, and this is preferably done at the same time as the classifying described above.

The obtained powder of the toners after drying may be mixed with other particles such as release agent, charge control agent, flowability enhancer, colorant particulates, and the like, and a mechanical impact may be given to the mixed powder so that the particles are fixed or fused on the surface to each other, which prevents separation of the particles from the surface of the obtained complex particles.

Specific methods for doing this include giving an impact to the mixture by high speed rotating blades, introducing the mixture into a high-speed gas flow to be accelerated so that the particles collide with each other or the complex particles are made to strike a suitable impact plate, and the like. The device used for this purpose may be an Angmill (available from Hosokawa Micron Corporation) or I-mill (available from Japan Pneumatic) that is modified to reduce the air pressure upon pulverizing, a Hybridization system (available from Nara Machine Laboratories), a Kryptron system (available from Kawasaki Heavy Industries), an automatic mortar, or the like.

(Carrier for Double Component Developing Agent)

If the toner of the present invention is used in a double-component developer, it may be used in combination with a magnetic carrier, and the blending ratio of the carrier and the toner in the developer is preferably 1 part by weight to 10 parts by weight of the toner, relative to 100 parts by weight of the carrier. The magnetic carrier may be any of those known in the art. Examples of the magnetic carrier include iron powder, ferrite powder, magnetite powder, a magnetic resin carrier, or the like, each of which has a particle diameter of approximately 20 $\mu$m to 200 $\mu$m. The carrier may be coated with a coating material. Examples of such coating materials are amino resins such as urea-formaldehyde resin, melamine resin, benzoguanamine resin, urea resin, polyamide resin, epoxy resin, and the like. Other examples are polyvinyl and polyvinylidene resins such as acrylic resins, polymethyl methacrylate resin, polyacrylonitrile resin, polyvinyl acetate resin, polyvinyl alcohol resin, polyvinyl butyral resin, polystyrene resins such as styrene-acryl copolymer resin, halogenated olefin resins such as polyvinyl chloride, polyester resins such as polyethylene terephthalate resin and polybutylene terephthalate resin, polycarbonate resins, polyethylene resins, polyvinyl fluoride resin, polyvinylidene fluoride resin, polytrifluoro ethylene resin, polyhexafluoropropylene resin, copolymers of vinylidene fluoride with acrylic monomers, copolymers of vinylidene fluoride with vinyl fluoride, fluoroterpolymers such as the terpolymer of tetrafluoroethylene, vinylidene fluoride and a non-fluoride monomer, silicone resins, and the like. An electroconducting powder or the like may also be contained in the coating material if necessary. Examples of electroconducting powders are metal powders, carbon black, titanium oxide, tin oxide, zinc oxide, and the like. These electroconducting powders preferably have an average particle diameter of 1 μm or less. If the average particle diameter is more than 1 μm, it is difficult to control electrical resistance.

The toner of the present invention may also be used as a single-component magnetic toner which does not use a carrier. The toner of the present invention may also be used as a non-magnetic toner.

(Toner Container)

The toner container which is holding the toner of the present invention is characterized in that it is filled with the color toner of the present invention for forming images.

(Image Forming Apparatus)

The image forming apparatus of the present invention comprises:

a latent image carrier, a charger which charges the latent image carrier, an exposer which exposes imagewise upon the latent image carrier charged by the charger so as to form an electrostatic latent image, an image developer which includes a toner-holding container attached thereon which supplies a developing agent to the electrostatic latent image, the image developer rendering the electrostatic image visible to form a toner image, and a transfer which transfers the toner image formed by the image developer to a transfer material, wherein there is no particular limitation except that the toner-holding container holds a developer including the color toner of the present invention for forming images, and known members for an image forming apparatus may suitably used in combination. The developing agent may be a single component developing agent containing the color toner of the present invention for forming images, or may be a double component developing agent further containing a carrier. The image forming apparatus allows to obtain sufficient anti-offset properties even with the fixing methods in which release oil is not applied or applied in a very small amount to a fixing roller.

(Process Cartridge)

The process cartridge for image forming of the present invention comprises:

at least a latent image carrier, at least one of a charger which uniformly charges the surface of the image carrier and a cleaner which cleans the surface of the image carrier, and an image developer which supplies a developing agent over a latent image on the latent image carrier so as to render the latent image visible to form a toner image, wherein the process cartridge can be attached to and detached from the main body of an image forming apparatus as a single unit, and the image developer is filled with a developer containing the color toner of the present invention for forming images.

By using the process cartridge for image forming of the present invention attached to the main body of an image forming apparatus, it is possible to obtain sufficient anti-offset properties even with the fixing methods in which release oil is not applied or applied in a very small amount to a fixing roller.

FIG. 1 shows an example of configuration of the process unit (process cartridge) for image forming (106). The process unit comprises a photoconductor (101) as the latent carrier, a charging roller (103) as the charger, a cleaner (105) as the cleaner, and an image developer (102) as the image developer, all of which is configured as a unit which can be attached to and detached from the main body of a printer. The image developer (102) includes a developing sleeve (104).

(Process for Forming Image)

The process for forming an image of the present invention comprises:

charging a latent image carrier, exposing the charged latent image carrier imagewise so as to form an electrostatic latent image, developing the electrostatic latent image by supplying a developing agent to the electrostatic latent image to render the electrostatic latent image visible so as to form a toner image, and transferring the toner image which is formed by developing to a transfer material, wherein there is no particular limitation except that the developing agent includes the color toner of the present invention for forming images.

EXAMPLES

The present invention will now be described in more detail with reference to specific examples, but it should not be limited in any way thereby. Hereinafter, "part" represents "part by weight" and "parts" represents "parts by weight".

Here, examples of the manufacture of a modified resin is given.

(Manufacture of Modified Resin-1)

450 parts of xylene and 150 parts of a low molecular weight polyethylene (Manufactured by Sanyo Chemical Industries, Ltd., Sunwax LEL-400, softening point 128° C., weight average molecular weight Mw=5600, number average molecular weight Mn=4000) were introduced into an autoclave reaction vat fitted with a thermometer and stirrer, and thoroughly dissolved. After replacing the atmosphere by nitrogen, a mixed solution of 594 parts of styrene, 255 parts of methyl methacrylate, 34.3 parts of di-t-butylperoxyhexahydroterephthalate and 120 parts of xylene, was dripped in at 155° C. for 2 hours to carry out a polymerization, and the mixture was kept at this temperature for 1 hour. Next, the solvent was removed, and a modified resin ((a)) having an average ester group concentration of 13.2%, number average molecular weight of 3300, weight average molecular weight of 12000 and glass transition temperature of 65.2° C., was obtained.

(Manufacture of Modified Resin-2)

450 parts of xylene and 150 parts of carnauba wax (Manufactured by TOA KASEI CO. LTD., softening point 75° C.) were introduced into an autoclave reaction vat fitted with a thermometer and stirrer, and thoroughly dissolved. After replacing the atmosphere by nitrogen, a mixed solution of 594 parts styrene, 255 parts methyl methacrylate, 34.3 parts di-t-butylperoxyhexahydroterephthalate and 120 parts xylene, was dripped in at 160° C. for 2 hours to carry out a polymerization, and the mixture was kept at this temperature for 1 hour. Next, the solvent was removed, and a modified resin ((b)) having an average ester group concentration of 13.2%, a number average molecular weight of 3400, a weight average molecular weight of 12300 and a glass transition temperature of 64.8° C., was obtained.

(Manufacture of Modified Resin-3)

450 parts of xylene and 200 parts of a low molecular weight polyethylene (Manufactured by Sanyo Chemical Industries, Ltd., Sunwax LEL-400, softening point 128° C., weight average molecular weight Mw=5600, number average molecular weight Mn=4000) were introduced into an autoclave reaction vat fitted with a thermometer and stirrer, and thoroughly dissolved. After replacing the atmosphere by nitrogen, a mixed solution of 600 parts styrene, 200 parts butyl acrylate, 16.1 parts di-t-butylperoxyhexahydroterephthalate and 120 parts xylene, was dripped in at 155° C. for 2 hours to carry out a polymerization, and the mixture was kept at this temperature for 1 hour. Next, the solvent was removed, and a modified resin ((c)) having an average ester group concentration of 8.5%, a number average molecular weight of 5300, a weight average molecular weight of 18500 and a glass transition temperature of 52.0° C., was obtained.

(Manufacture of Modified Resin-4)

450 parts of xylene and 200 parts of a low molecular weight polypropylene (Manufactured by Sanyo Chemical Industries, Ltd., Viscol 440P, softening point 153° C., weight average molecular weight Mw=15000, number average molecular weight Mn=9000) were introduced into an autoclave reaction vat fitted with a thermometer and stirrer, and thoroughly dissolved. After replacing the atmosphere by nitrogen, a mixed solution of 280 parts styrene, 520 parts methyl methacrylate, 32.3 parts di-t-butylperoxyhexahydroterephthalate and 120 parts xylene, was dripped in at 150° C. for 2 hours to carry out a polymerization, and the mixture was kept at this temperature for 1 hour. Next, the solvent was removed, and a modified resin ((d)) having an average ester group concentration of 28.6%, number average molecular weight of 3300, weight average molecular weight of 16000 and glass transition temperature of 58.8° C., was obtained.

(Manufacture of Modified Resin-5)

400 parts of xylene and 150 parts of a low molecular weight polypropylene (Manufactured by Sanyo Chemical Industries, Ltd., Viscol 440P, softening point 153° C., weight average molecular weight Mw=15000, number average molecular weight Mn=9000) were introduced into an autoclave reaction vat fitted with a thermometer and stirrer, and thoroughly dissolved. After replacing the atmosphere by nitrogen, a mixed solution of 665 parts styrene, 185 parts butyl acrylate, 8.5 parts di-t-butylperoxyhexahydroterephthalate and 120 parts xylene, was dripped in at 160° C. for 2 hours to carry out a polymerization, and the mixture was kept at this temperature for 1 hour. Next, the solvent was removed, and a modified resin ((e)) having an average ester group concentration of 7.49%, number average molecular weight of 8300, weight average molecular weight of 22900 and glass transition temperature of 60.5° C., was obtained.

(Manufacture of Modified Resin-6)

450 parts of xylene and 200 parts of a low molecular weight polypropylene (Manufactured by Sanyo Chemical Industries, Ltd., Viscol 440P, softening point 153° C., weight average molecular weight Mw=15000, number average molecular weight Mn=9000) were introduced into an autoclave reaction vat fitted with a thermometer and stirrer, and thoroughly dissolved. After replacing the atmosphere by nitrogen, a mixed solution of 200 parts styrene, 600 parts methyl methacrylate, 32.3 parts di-t-butylperoxyhexahydroterephthalate and 120 parts xylene, was dripped in at 150° C. for 2 hours to carry out a polymerization, and the mixture was kept at this temperature for 1 hour. Next, the solvent was removed, and a modified resin ((f)) having an average ester group concentration of 33.0%, number average molecular weight of 3200, weight average molecular weight of 17000 and glass transition temperature of 55.3° C., was obtained.

(Manufacture of Modified Resin (Vinyl Polymer)-7)

450 parts of xylene was introduced into an autoclave reaction vat fitted with a thermometer and stirrer, and thoroughly dissolved. After replacing the atmosphere by nitrogen, a mixed solution of 700 parts styrene, 300 parts methyl methacrylate, 34.3 parts di-t-butylperoxyhexahydroterephthalate and 120 parts xylene, was dripped in at 155° C. for 2 hours to carry out a polymerization, and the mixture was kept at this temperature for 1 hour. Next, the solvent was removed, and a vinyl polymer ((g)) having an average ester group concentration of 13.2%, number average molecular weight of 3500, weight average molecular weight of 9100 and glass transition temperature of 68.8° C., was obtained.

<Synthesis of Organic Particulate Emulsion>

Manufacture Example 1

To a reaction vessel provided with a stirrer and thermometer, 683 parts of water, 11 parts of the sodium salt of the sulfuric acid ester of methacrylic acid ethylene oxide adduct (ELEMINOL RS-30, Sanyo Chemical Industries, Ltd.), 138 parts of styrene, 138 parts of methacrylic acid, and 1 part of ammonium persulphate were introduced, and stirred at 400 rpm/min for 15 minutes to give a white emulsion. This was heated, the temperature in the system was raised to 75° C. and the reaction performed for 5 hours. Next, 30 parts of an aqueous solution of 1% ammonium persulphate was added, and the reaction mixture was matured at 75° C. for 5 hours to obtain an aqueous dispersion of a vinyl resin "particulate emulsion 1" (copolymer of styrene-methacrylic acid-sodium salt of the sulfuric acid ester of methacrylic acid ethylene oxide adduct). The volume average particle diameter of "particulate emulsion 1" measured by LA-920 was 0.14 $\mu$m. After drying part of "particulate emulsion 1" and isolating the resin, Tg of the resin was 152° C.

<Preparation of Aqueous Phase>

Manufacture Example 2

To 990 parts of water, 83 parts of "particulate emulsion 1," 37 parts of a 48.5% aqueous solution of sodium dodecyl diphenylether disulfonic acid (ELEMINOL MON-7: Sanyo Chemical Industries, Ltd.) and 90 parts of ethyl acetate were mixed and stirred together to obtain a milky liquid. This was taken as "aqueous phase 1."

<Synthesis of Low Molecular Weight Polyester>

Manufacture Example 3

In a reaction vessel equipped with a condenser, stirrer, and nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were placed, and the reaction was performed under normal pressure at 230° C. for 8 hours, and under a reduced pressure of 10–15 mmHg for 5 hours, then 44 parts of anhydrous trimellitic acid was introduced into the reaction vessel, and the reaction performed at 180° C. under normal pressure for 2 hours to obtain "low molecular weight polyester 1." The "low molecular weight polyester 1" had a number average molecular weight of 2,500, weight mean molecular weight of 6,700, Tg of 43° C. and acid value of 25.

<Synthesis of Intermediate Polyester>

Manufacture Example 4

In a reaction vessel equipped with a condenser, stirrer, and nitrogen inlet tube, 682 parts of bisphenol A ethylene oxide dimolar adduct, 81 parts of bisphenol A propylene oxide dimolar adduct, 283 parts of terephthalic acid, 22 parts of anhydrous trimellitic acid and 2 parts of dibutyl tin oxide were placed, and the reaction was performed under normal pressure at 230° C. for 8 hours, and then under a reduced pressure of 10 mmHg to 15mmHg for 5 hours to obtain "intermediate polyester 1." The "intermediate polyester 1" had a number average molecular weight of 2,100, weight average molecular weight of 9,500, Tg of 55° C., acid value of 0.5 and hydroxyl value of 51.

Next, 410 parts of "intermediate polyester 1," 89 parts of isohorone diisocyanate and 500 parts of ethyl acetate were placed in a reaction vessel equipped with a condenser, stirrer, and nitrogen inlet tube, and the reaction was performed at 100° C. for 5 hours to obtain "prepolymer 1." The free isocyanate % by weight of "prepolymer 1" was 1.53%.

<Synthesis of Ketimine>

Manufacture Example 5

Into a reaction vessel equipped with a stirrer and thermometer, 170 parts of isohorone diamine and 75 parts of methyl ethyl ketone were introduced, and the reaction was performed at 50° C. for 5 hours to obtain "ketimine compound 1." The amine value of "ketimine compound 1" was 418.

The evaluation methods and conditions used in the experiments are shown below.

(1) Gloss

[a]Adjustments were made to develop a toner of 1.0±0.1 mg/cm$^2$, using a modified Pretel 650 Ricoh color copier wherein the fixing roller was replaced by a PFA tubing-coated roller, and the silicone oil coating apparatus had been removed. The gloss of a beta image sample when temperature of the fixing roller surface was 160° C., was measured at an incidence angle of 60° C. using a Gloss Meter manufactured by Nippon Denshoku Industries Co., Ltd. The transfer paper was a Ricoh color PPC paper, type 6000<70W. Glossiness is higher as the number of the value is increased. A glossiness of approximately 10% or more is required to obtain a clear image having excellent color reproducibility.

The fixing roller had 25 μm PFA tubing coated on 2 mm silicone rubber, the fixing pressure was 80 kg, the nip width was 8 mm, and the shape of the nip was concave towards the fixing roller side. The fixing roller heating output was 650 W, and the pressure roller heating output was 400 W.

[b] A Ricoh printer IPSIO8000 was modified as follows. The original fixing apparatus was removed, and another fixing apparatus from which the oil coating mechanism had been removed was installed. Moreover the fixing apparatus was designed to allow the set temperature changeable. As in [a], adjustments were made to develop a toner of 1.0±0.1 mg/cm$^2$, and the gloss of a beta image sample when the fixing roller surface temperature was 160° C., was measured at an incidence angle of 60° C. using a Nippon Denshoku Industries Co., Ltd. Gloss Meter. The transfer paper was a Ricoh color PPC paper, type 6000<70W. Glossiness is higher as the number of the value is increased. A glossiness of approximately 10% or more is required to obtain a clear image having excellent color reproducibility.

Figure 2:
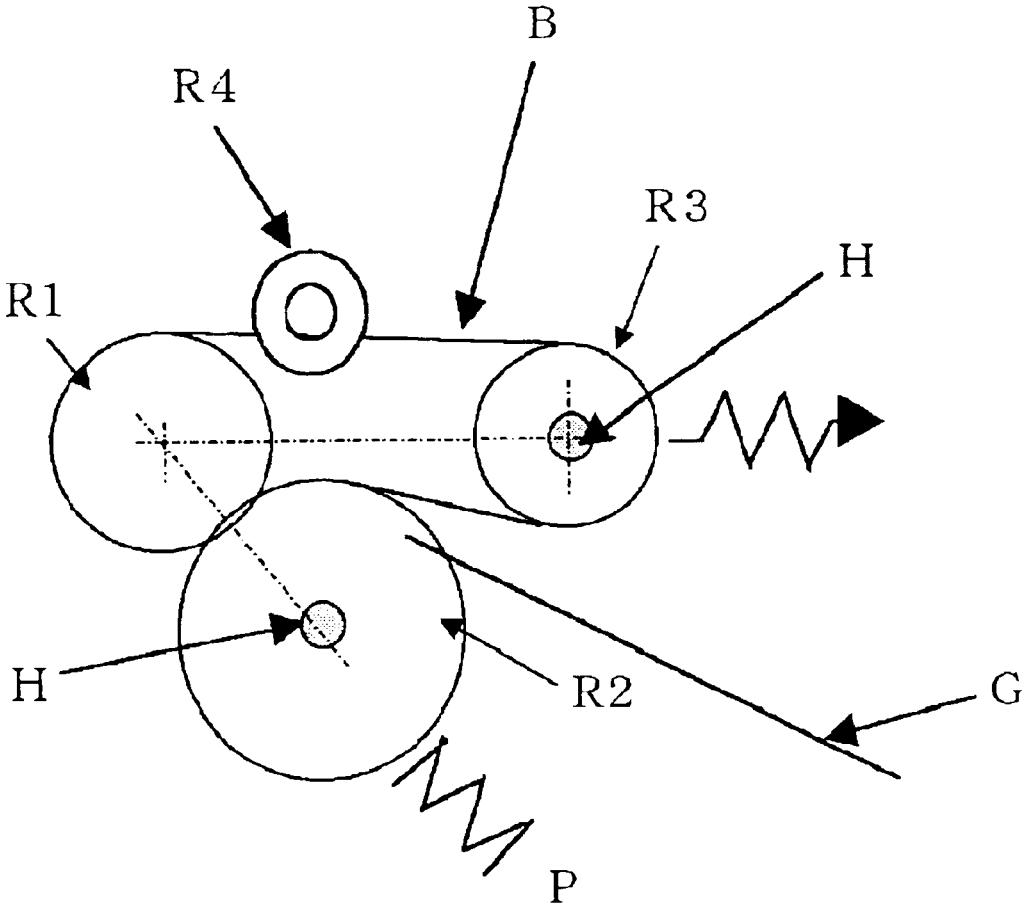
FIG. 2 is a schematic view of an example of an image-forming process cartridge of the present invention.

The fixing apparatus used was the belt heat fixing apparatus shown in FIG. 2. The fixing roller (R1) was made of silicone foam, the metal cylinder of the pressure roller (R2) was SUS, 1 mm thick, the anti-offset layer of the pressure roller (R2) was made of PFA tubing and silicone rubber, 1 mm thick, the heat roller (R3) was aluminum of thickness 2 mm, the base of the belt (B) was 50 μm polyimide, the offset prevention layer of the belt (B) was 15 μm silicone rubber, the surface pressure was $1\times10^5$ Pa and the linear velocity was 200 mm/sec. In FIG. 2, R4 is an oil-applying roller, P a pressure spring, G a guide, and H a heat source.

(2) Offset Properties

Using the modified Pretel 650 Ricoh color copier that was employed in the gloss tests, the temperature of the fixing roller was increased every 5° C., and the temperature at which offset started was measured. Regarding the fixing roller, tests were performed without coating oil, and the transfer paper was Ricoh full color PPC paper type 6000<70W.

The evaluation of results is shown as below.

Very Good: Offset does not occur until extremely high temperature, and anti-offset properties are excellent.

Good: Offset does not occur until high temperature, and anti-offset properties are very good.

Fair: Anti-offset properties are insufficient, but anti-offset properties are satisfied if only a small amount of silicone oil (0.5-1 mg/A4 size) is applied.

Bad: Offset occurs from low temperature, and anti-offset properties are poor even if only a small amount of silicone oil is applied.

(3) Transfer Properties

Using an identical copier to that used for the gloss tests, the copier was stopped during transfer to the transfer paper, and the toner amount remaining on the intermediate transfer belt was visually observed and assessed according to the following scale.

Very Good: Transfer toner residue is hardly remained, and transfer properties are excellent Good: Transfer toner residue is remained only a small amount, and transfer properties are excellent.

Fair: Identical transfer properties to those of the wax-containing color toner in the related art Bad: Transfer toner residue is remained an extremely large amount, and transfer properties are poor.

(4) Durability

Using an identical printer [b] to that used for the gloss tests, a test chart of surface area 10% was copied 50000 times, and the decline in the charge amount of the developing agent was evaluated.

Very Good: Very little decline of charge amount, and excellent durability

Good: Little decline of charge amount, and excellent durability

Fair: Identical durability to that of the wax-containing color toner of the related art.

Bad: Very large decrease of charge amount, and poor durability.

(5) Charge Stability with Humidity

A two-component developing agent was manufactured under the conditions of 10° C., 15% RH and 30° C., 90% RH. If the absolute values of the charge amount measured by the blow off method are respectively L (μc/g), and H (μc/g), the environmental fluctuation rate is given by the following equation. The environmental fluctuation rate is preferably at least of the order of 40% or less, but more preferably 20% or less.

$$\text{Environmental fluctuation rate}=2(L-H)/(L+H)\times100(\%)$$

The test criteria in Table 1 are given below.

Very Good: Environmental fluctuation rate is 20% or less

Good: Environmental fluctuation rate is 21% to 40%

Fair: Environmental fluctuation rate is 41% to 70%

Bad: Environmental fluctuation rate is 71% or higher (6) Fine Line Reproducibility For various developing agents, an image test was performed and the fine line reproducibility was evaluated in 5 steps as follows:

Very Good, Good, Fair, Bad, and Very Bad

Example 1

<Preparation of Oil Phase>

Into a vessel equipped with a stirrer and thermometer, 578 parts of "low molecular weight polyester 1," 90 parts of synthetic wax, 180 parts of modified resin (a), 22 parts of CCA (salicylic acid metal complex E-84: Orient Chemical Industries) and 947 parts of ethyl acetate were introduced, and the temperature was raised to 80° C. with stirring, maintained at 80° C. for 5 hours, and cooled to 30° C. in 1 hour. Next, 300 parts of C.I. Pigment Red 122 (Magenta R: Toyo Ink Mfg. Co., Ltd.) and 500 parts of ethyl acetate were introduced into the vessel, and mixed for 1 hour to obtain "initial material solution 1."

To a vessel, 1324 parts of "initial material solution 1" were transferred, and a pigment and wax were dispersed using a bead mill (ultra bead mill, Imex) under the conditions of liquid feed rate 1 kg/hr, disk circumferential speed of 6 m/sec, 0.5 mm zirconia beads packed to 80% volume % and 3 passes. Next, 1324 parts of a 65% ethyl acetate solution of "low molecular weight polyester 1" was added and dispersed in 1 pass by the bead mill under the aforesaid conditions to obtain "pigment/WAX dispersion 1". The solids concentration of "pigment/WAX dispersion 1" (130° C., 30 minutes) was 50%.

<Emulsification and Solvent Removal>

In a vessel, 664 parts of "pigment/WAX dispersion 1," 139 parts of "prepolymer 1" and 5.9 parts of "ketimine compound 1" were placed and mixed at 5,000 rpm for 1 minute by a TK homomixer (Special Machinery), then 1200 parts of "aqueous phase 1" were added to the vessel and mixed in the TK homomixer at a rotation speed of 13,000 rpm for 20 minutes to obtain "emulsion slurry 1."

"Emulsion slurry 1" was placed in a vessel equipped with a stirrer and thermometer, then the solvent was removed at 30° C. for 8 hours and the product was matured at 45° C. for 4 hours to obtain "dispersion slurry 1."

<Rinsing and Drying>

After filtering 100 parts of "dispersion slurry 1" under reduced pressure, (1): 100 parts of ion exchange water were added to the filter cake, mixed in a TK homomixer (rotation speed 12000 rpm, 10 minutes) and filtered.

(2): 100 parts of 10% sodium hydroxide were added to the filter cake of (1), mixed in a TK homomixer (rotation speed 12000 rpm, and 30 minutes) and filtered under reduced pressure.

(3): 100 parts of 10% hydrochloric acid were added to the filter cake of (2), mixed in a TK homomixer (rotation speed 12000 rpm, 10 minutes) and filtered.

(4): 300 parts of ion exchange water were added to the filter cake of (3), mixed in a TK homomixer (rotation speed 12000 rpm, 10 minutes), and filtered. This procedure was done twice to obtain "filter cake 1."

"Filter cake 1" was dried in a circulating air dryer at 45° C. for 48 hours, and sieved through a sieve of 75 $\mu$m mesh. Then, 100 parts of the toner particles, 0.5 part of hydrophobic silica (surface-treated with hexamethyldisilane, specific surface: 200 $m^2/g$), and 0.5 part of hydrophobicized rutile titanium oxide (surface-treated with isobutylmethoxysilane, average primary particle diameter: 0.02 $\mu$m) were mixed with a Henschel mixer to obtain Toner A. The THF-insoluble component of this toner was 10%, and the molecular weight Mw by GPC of the THF-insoluble component was about 18000. The image glossiness of this toner was observed with the device of (a), and the glossiness was 23%, which was suitable glossiness for a color toner. When observed with the device of (b), the glossiness was 15%.

Figure 3:
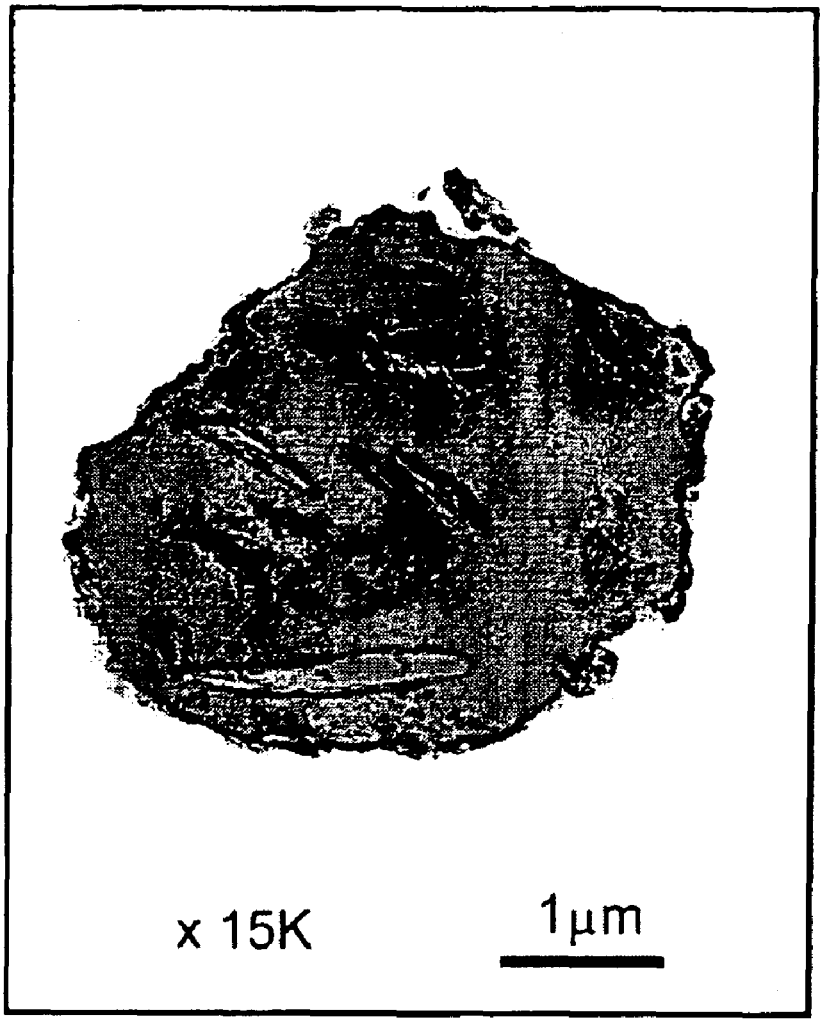
FIG. 3 is an example of a transmission electron microscopic (TEM) photograph of a slice of a toner particle, in accordance with an embodiment the present invention.
Figure 4:
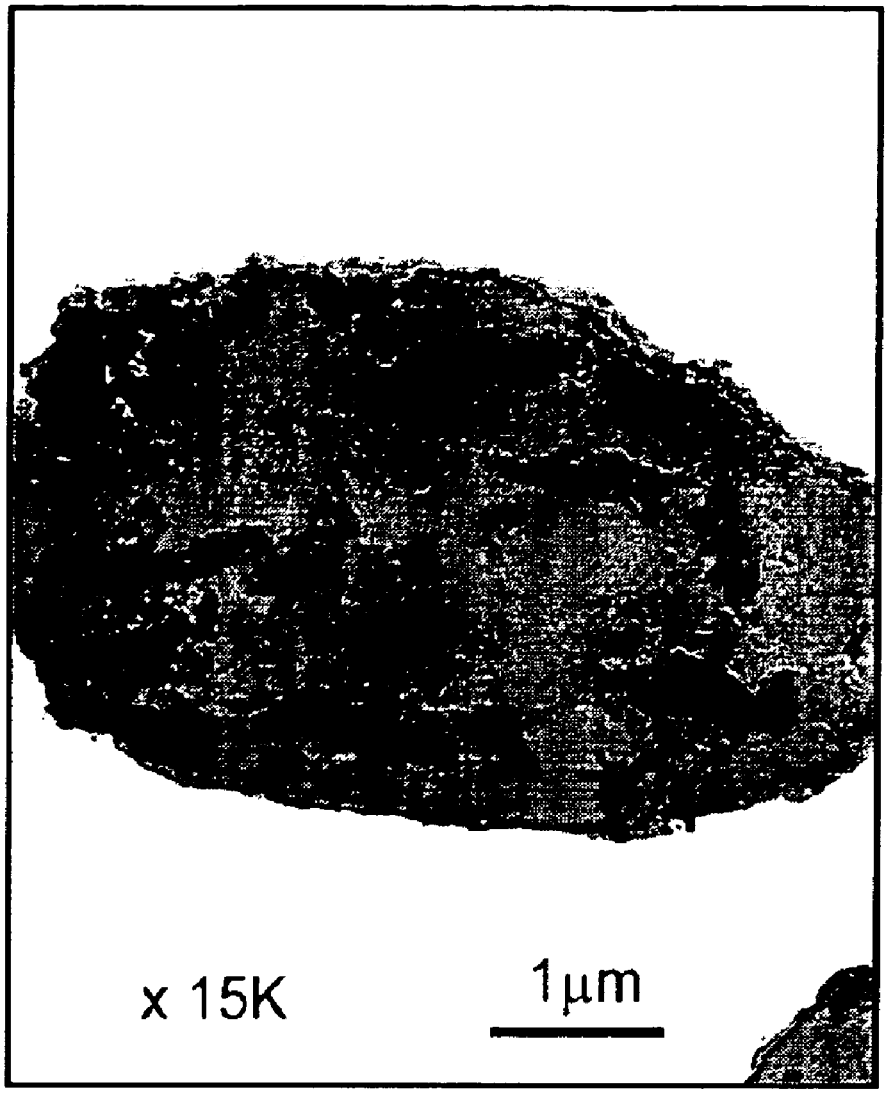
FIG. 4 is another example of a transmission electron microscopic (TEM) photograph of a slice of a toner particle, in accordance with an embodiment the present invention.
Figure 5:
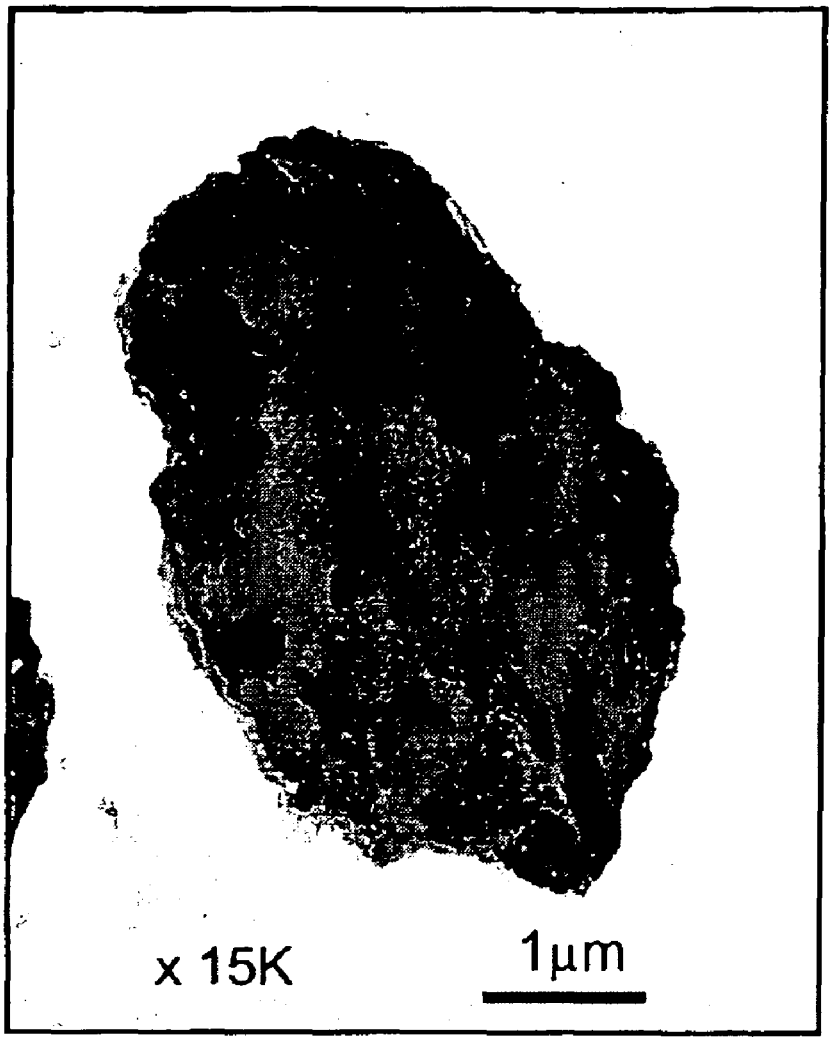
FIG. 5 is another example of a transmission electron microscopic (TEM) photograph of a slice of a toner particle, in accordance with an embodiment the present invention.

Very thin slices of Toner A were formed using a cryomicrotome, the slices were dyed with ruthenium tetroxide, and then they were observed with a transmission electron microscope (TEM). It was found that the modified resin was dispersed in a continuous phase of the resin and that the release agent was embraced in the modified resin. Referring to the TEM photographs of toner particles shown in FIGS. 3 to 5, the dark colored portions which surround the dispersed phases in the toner particles are the modified resin (dyed portions). When the rod-like crystals inside the dark edges were further magnified, lamellar structures, which are characteristic of wax, were observed.

The lengths of the dispersions in the TEM images were measured along the long axis, and the result was that there were 10 to 20 islands of 0.2 $\mu$m to 1.2 $\mu$m in each particle.

Example 2

<Synthesis of Masterbatch (MB)>

In a reaction vessel equipped with a condenser, stirrer, and nitrogen inlet tube, 319 parts of bisphenol A propylene oxide dimolar adduct, 449 parts of bisphenol A ethylene oxide dimolar adduct, 243 parts of terephthalic acid, 53 parts of adipicacid and 2 parts of dibutyl tin oxide were placed, and the reaction was performed under normal pressure at 230° C. for 8 hours, and then under a reduced pressure of 10 mmHg to 15 mmHg for 5 hours to obtain "polyester for MB 1." The "polyester for MB 1" had a number average molecular weight of 1900, weight average molecular weight of 6100, Tg of 43° C., and acid value of 1.1.

Next, 30 parts of water, 40 parts of C.I. Pigment Red 122 (Magenta R: Toyo Ink Mfg. Co., Ltd.), and 60 parts of "polyester for MB 1," were mixed with a Henschel mixer (Mitsui Mining) to obtain a mixture of a pigment aggregate which is penetrated by water. The mixture is kneaded with a two-roller at 130° C. for 45 minutes, rolled, cooed, and pulverized with a pulverizer to obtain "masterbatch 1."

<Preparation of Oil Phase>

Into a vessel equipped with a stirrer and thermometer, 378 parts of "low molecular weight polyester 1," 90 parts of synthetic wax, 180 parts of modified resin (a), 22 parts of CCA (salicylic acid metal complex E-84: Orient Chemical Industries) and 947 parts of ethyl acetate were introduced, and the temperature was raised to 80° C. with stirring, maintained at 80° C. for 5 hours, and cooled to 30° C. in 1 hour. Next, 500 parts of "masterbatch 1"and 500 parts of ethyl acetate were introduced into the vessel, and mixed for 1 hour to obtain "initial material solution 2."

To a vessel, 1324 parts of "initial material solution 2" were transferred, and carbon black and wax were dispersed using a bead mill (ultra bead mill, Imex) under the conditions of liquid feed rate 1 kg/hr, disk circumferential speed of 6 m/sec, 0.5 mm zirconia beads packed to 80% volume % and 3 passes. Next, 1324 parts of a 65% ethyl acetate solution of "low molecular weight polyester 1" was added and dispersed in 1 pass by the bead mill under the aforesaid conditions to obtain "pigment/WAX dispersion 2". The solids concentration of "pigment/WAX dispersion 2" (130° C., 30 minutes) was 50%.

<Emulsification and Solvent Removal> and <Rinsing and Drying>

These steps were conducted in the same manner as Example 1 except that "pigment/WAX dispersion 1" was replaced with "pigment/WAX dispersion 2" to obtain Toner B.

Example 3

The steps were conducted in the same manner as Example 2 except that the time for mixing with a TK homomixer at a rotation speed of 13000 was changed from 20 minutes to 10 minutes when pigment/WAX dispersion was mixed with an aqueous phase to obtain emulsion slurry. Thus Toner C was obtained.

Example 4

The steps were conducted in the same manner as Example 2 except that the time for mixing with a TK homomixer at a rotation speed of 13000 was changed from 20 minutes to 45 minutes when pigment/WAX dispersion was mixed with an aqueous phase to obtain emulsion slurry. Thus Toner D was obtained.

| (Comparative example 1) | |
|---|---|
| Polyester resin (weight average molecular weight 5900, Tg 63° C., THF-insoluble 12%) | 100 parts |
| Synthesized ester wax | 4 parts |
| Masterbatch 1 | 12 parts |
| Zinc stearate | 2 parts |

These materials were kneaded using a 2-axis extruder at 100° C., pulverized, and classified to obtain toner particles. Then, 100 parts of toner particles, 0.5 part of hydrophobic silica (surface-treated with hexamethyldisilane, specific surface: 200 $m^2/g$), and 0.5 part of hydrophobicized rutile titanium oxide (surface-treated with isobutylmethoxysilane, average primary particle diameter: 0.02 $\mu$m) were mixed with a Henschel mixer to obtain Toner E. The THF-insoluble component of this toner was 8%, and the molecular weight Mw by GPC of the THF-insoluble component was about 19000. Results of evaluation are shown in Table 1.

Example 5

Toner F was obtained in an identical way to that of Example 2, except that the polyester resin (A) in Example 1 was replaced by a polyester resin (B) (THF insoluble fraction: 10 wt %, Mw: 100000, Tg: 65° C., Tm: 145° C., SP value: 10.7).

Example 6

A Toner G was manufactured in an identical way to that of Example 2, except that the graft polymer resin ((a)) of Example 1 was replaced by a graft polymer resin ((b)).

Example 7

A Toner H was manufactured in an identical way to that of Example 2, except that the graft polymer resin ((a)) of Example 1 was replaced by a graft polymer resin ((c)).

Example 8

A Toner I was manufactured in an identical way to that of Example 2, except that the graft polymer resin ((a)) of Example 1 was replaced by a graft polymer resin ((d)).

Example 9

A Toner J was manufactured in an identical way to that of Example 2, except that the synthetic ester wax in Example 1 was replaced by 5 parts of a free fatty acid eliminated carnauba wax (Mp: 82° C.).

Example 10

A Toner K was manufactured in an identical way to that of Example 2, except that the synthetic ester wax in Example 1 was replaced by 5 parts of a low molecular weight polyethylene (Mp: 92° C.).

Example 11

A Toner L was manufactured in an identical way to that of Example 2, except that the 180 parts of the graft polymer resin ((a)) in Example 1 was replaced by 90 parts.

Example 12

A Toner M was manufactured in an identical way to that of Example 1, except that the 180 parts of the graft polymer resin ((a)) in Example 1 was replaced by 5.4 parts.

Example 13

A Toner N was manufactured in an identical way to that of Example 1, except that the 180 parts of the graft polymer resin in Example 1 was replaced by 270 parts.

Comparative Example 2

A Toner O was manufactured in an identical way to that of Example 2, except that the graft polymer resin ((a)) of Example 1 was replaced by a graft polymer resin ((e)).

Comparative Example 3

A Toner P was manufactured in an identical way to that of Example 2, except that the graft polymer resin ((a)) of Example 1 was replaced by a graft polymer resin ((f)).

Comparative Example 4

A Toner Q was manufactured in an identical way to that of Example 2, except that the graft polymer resin ((a)) of Example 1 was replaced by a graft polymer resin ((g)).

Comparative Example 5

A toner was prepared in an identical way to that of Example 1, except that the graft polymer resin ((a)) of Example 1 was removed, and a Toner R was obtained. When the cross-section of the Toner R was observed under a transmitting electron microscope, it was found that the wax was incompatible with the resin, had a phase separation structure, and wax dispersion particles having a long axis of as large as 3 $\mu$m were frequently observed. Also, the same additives as those of Example 2 were added.

A sample of this toner was prepared in the same way as for glossiness measurement, except that the copier (a), and OHP paper (TYPE PPC-DX (Manufactured by Ricoh Elemex Corporation) was used to measure color characteristics and glossiness. When the haze (proportion of diffused light transmittance relative to total light transmittance (also referred to as cloudiness or cloudiness value)) was measured, it was 40% which was poor compared to the toner of the Examples, all the toners of the Examples showing 30% or less.

The test results for each toner/developing agent are shown in Table 1.

TABLE 1

| | PDD | | Gloss (%) | | Offset | Transfer | | Charge | Fine Line |
|---|---|---|---|---|---|---|---|---|---|
| | Dv(μm) | Dv/Dn | (a) | (b) | properties | properties | Durability | stability | reproducibility |
| Ex. 1 | 6.1 | 1.16 | 23 | 15 | G-VG | G-VG | G-VG | G | VG |
| Ex. 2 | 6.0 | 1.14 | 25 | 16 | G-VG | G-VG | G-VG | G | G |
| Ex. 3 | 4.5 | 1.12 | 27 | 18 | G-VG | G-VG | G-VG | VG | VG |
| Ex. 4 | 8.7 | 1.27 | 22 | 14 | G-VG | G-VG | G-VG | VG | VG |
| Ex. 5 | 6.1 | 1.14 | 16 | 10 | G-VG | G | G-VG | VG | VG |
| Ex. 6 | 6.1 | 1.15 | 21 | 12 | G-VG | G | G-VG | G | VG |
| Ex. 7 | 6.2 | 1.14 | 26 | 17 | G-VG | G-VG | G-VG | VG | VG |
| Ex. 8 | 6.2 | 1.14 | 26 | 17 | G-VG | G | G | G | VG |
| Ex. 9 | 6.1 | 1.14 | 29 | 16 | VG | G-VG | G-VG | G | VG |
| Ex. 10 | 6.0 | 1.13 | 26 | 14 | G | G-VG | G-VG | G | VG |
| Ex. 11 | 6.1 | 1.13 | 29 | 18 | G-VG | G-VG | G-VG | G | VG |
| Ex. 12 | 6.2 | 1.14 | 30 | 20 | G-VG | G | G | G | VG |
| Ex. 13 | 6.1 | 1.14 | 22 | 14 | G-VG | VG | VG | VG | VG |
| Comp. Ex. 1 | 6.1 | 1.13 | 8 | 4 | G-VG | F | F-G | F-G | VG |
| Comp Ex. 2 | 6.1 | 1.13 | 26 | 16 | G-VG | F | F-G | B | VG |
| Comp. Ex. 3 | 6.1 | 1.14 | 29 | 20 | G-VG | F | F-G | G | VG |
| Comp. Ex. 4 | 6.1 | 1.14 | 21 | 14 | G-VG | F | F | G | VG |
| Comp. Ex. 5 | 6.1 | 1.14 | 27 | 18 | VG | F | F | F | VG |

Note:
PDD: Particle Diameter Distribution, VG: Very Good, G: Good, F: Fair, and B: Bad As described above, the present invention provides a color toner and a developing agent which give a suitable image gloss and have excellent color reproducibility, which have sufficient anti-offset properties even when a mold releasing oil is not coated on a fixing roller or is coated in only a small amount, and which have excellent transfer properties, durability, and charge stability to fluctuation of humidity. Further, the present invention provides a color toner and a developing agent which give a suitable image gloss and have excellent color reproducibility, which have sufficient anti-offset properties even when a mold releasing oil is not coated on a fixing roller or is coated in only a small amount, and which have excellent transfer properties, durability, and charge stability to fluctuation of humidity, even when belt heat fixing method is employed wherein the waiting time is short.

The present invention also provides a toner container filled with the toner of the present invention and an image-forming apparatus in which the toner container is installed.

What is claimed is:

1. A color toner for forming an image comprising:

a continuous phase of a resin containing a urea-modified polyester resin; and a modified resin dispersed in the continuous phase, wherein the modified resin contains:

a release polymer portion containing a release polymer; and a modified portion containing a plurality of vinyl monomer units, the modified portion having an average ester group concentration of 8% by weight to 30% by weight, wherein the color toner is formed by a process comprising:

emulsifying and suspending an organic solvent containing a modified polyester resin capable of forming a urea bond in an aqueous medium under an existence of a modified resin and a release agent;

allowing addition polymerization;

removing the organic solvent; and washing.

2. A color toner for forming an image according to claim 1, wherein the process comprises:

emulsifying and suspending an organic solvent containing a modified polyester resin capable of forming a urea bond, a modified resin, and a release agent dissolved therein in an aqueous medium;

allowing addition polymerization;

removing the organic solvent; and washing.

3. A color toner for forming an image according to claim 1, wherein at least a portion of the release agent is embraced in the modified resin.

4. A color toner for forming an image according to claim 1, wherein the modified resin is a graft copolymer having the release polymer as a main chain thereof and the modified portion containing a plurality of vinyl monomer units as side chains thereof, wherein the modified portion has an average ester group concentration of 8% by weight to 30% by weight.

5. A color toner for forming an image according to claim 1, wherein the average ester group concentration is 10% by weight to 25% by weight.

6. A color toner for forming an image according to claim 1, wherein the release polymer is a wax.

7. A color toner for forming an image according to claim 6, wherein the wax is at least one of a polyolefin wax and a natural wax.

8. A color toner for forming an image according to claim 1, wherein the wax is a polyolefin wax having a number average molecular weight of from 500 to 15000 and a weight average molecular weight of from 800 to 100000.

9. A color toner for forming an image according to claim 1, wherein the release polymer has a softening point of from 80° C. to 170° C.

10. A color toner for forming an image according to claim 1, wherein the vinyl monomer unit comprising at least one of alkyl ester monomer unit of unsaturated carboxylic acid and vinyl ester monomer unit.

11. A color toner for forming an image according to claim 1, wherein the resin forming the continuous phase comprises a component insoluble in tetrahydrofuran, and the tetrahydrofuran-insoluble component has a weight average molecular weight by gel permeation chromatography of 10000 to 50000.

12. A color toner for forming an image according to claim 1, wherein the release agent is at least one selected from carnauba wax, montan wax, oxidized rice wax, and synthetic wax.

13. A color toner for forming an image according to claim 1, wherein an amount of the modified resin X in the toner and an amount of the release agent Y in the toner satisfy the following formula:

$$0.1 \leqq Y/X \leqq 3.$$

14. A color toner for forming an image according to claim 1, wherein the weight average particle diameter is from 2.5 μm to 8.0 μm.

15. A color toner for forming an image according to claim 1, wherein the modified polyester resin capable of forming a urea bond is a prepolymer having a isocyanate group; and the modified polyester resin is emulsified and suspended under an existence of an amine, and allowed to react in addition polymerization.

16. A color toner for forming an image according to claim 1, wherein the step of emulsifying and suspending in the aqueous medium is conducted under an existence of a colorant, in addition to the existence of the modified resin and the release agent.

17. A color toner for forming an image according to claim 16, a masterbatch is used as the colorant, the masterbatch being formed in advance by kneading a resin and a colorant with water.

18. A double component developing agent comprising:

a color toner for forming an image; and a carrier, wherein the color toner for forming an image contains:

a continuous phase of a resin containing a urea-modified polyester resin; and a modified resin dispersed in the continuous phase, wherein the modified resin contains:

a release polymer portion containing a release polymer; and a modified portion containing a plurality of vinyl monomer units, the modified portion having an average ester group concentration of 8% by weight to 30% by weight, wherein the color toner is formed by a process comprising:

emulsifying and suspending an organic solvent containing a modified polyester resin capable of forming a urea bond in an aqueous medium under an existence of a modified resin and a release agent;

allowing addition polymerization;

removing the organic solvent; and washing.

19. A toner container comprising a color toner for forming an image filling the toner container, the color toner for forming an image containing:

a continuous phase of a resin containing a urea-modified polyester resin; and a modified resin dispersed in the continuous phase, wherein the modified resin contains:

a release polymer portion containing a release polymer; and a modified portion containing a plurality of vinyl monomer units, the modified portion having an average ester group concentration of 8% by weight to 30% by weight, wherein the color toner is formed by a process comprising:

emulsifying and suspending an organic solvent containing a modified polyester resin capable of forming a urea bond in an aqueous medium under an existence of a modified resin and a release agent;

allowing addition polymerization;

removing the organic solvent; and washing.

20. An image forming apparatus comprising:

a latent image carrier;

a charger which charges the latent image carrier;

an exposer which exposes imagewise upon the latent image carrier charged by the charger so as to form an electrostatic latent image;

an image developer which includes a toner-holding container attached thereon which supplies a developing agent to the electrostatic latent image, the image developer rendering the electrostatic image visible to form a toner image; and a transfer which transfers the toner image formed by the image developer to a transfer material, wherein the toner-holding container holds a developer including a color toner of for forming an image containing:

a continuous phase of a resin containing a urea-modified polyester resin; and a modified resin dispersed in the continuous phase, wherein the modified resin contains:

a release polymer portion containing a release polymer; and a modified portion containing a plurality of vinyl monomer units, the modified portion having an average ester group concentration of 8% by weight to 30% by weight, wherein the color toner is formed by a process comprising:

emulsifying and suspending an organic solvent containing a modified polyester resin capable of forming a urea bond in an aqueous medium under an existence of a modified resin and a release agent;

allowing addition polymerization;

removing the organic solvent; and washing.

21. A process cartridge for forming an image, comprising:

a latent image carrier;

at least one of a charger which uniformly charges the surface of the image carrier and a cleaner which cleans the surface of the image carrier; and an image developer which contains a developing agent and supplies the developing agent over a latent image on the latent image carrier so as to render the latent image visible to form a toner image, wherein the process cartridge can be attached to and detached from a main body of an image forming apparatus as a single unit; and the developer agent contains a color toner of for forming images containing:

a continuous phase of a resin containing a urea-modified polyester resin; and a modified resin dispersed in the continuous phase, wherein the modified resin contains:

a release polymer portion containing a release polymer; and a modified portion containing a plurality of vinyl monomer units, the modified portion having an average ester group concentration of 8% by weight to 30% by weight, wherein the color toner is formed by a process comprising:

emulsifying and suspending an organic solvent containing a modified polyester resin capable of forming a urea bond in an aqueous medium under an existence of a modified resin and a release agent;

allowing addition polymerization;

removing the organic solvent; and washing.

22. A process for forming an image comprising:

charging a latent image carrier, exposing the charged latent image carrier imagewise so as to form an electrostatic latent image, developing the electrostatic latent image by supplying a developing agent to the electrostatic latent image to render the electrostatic latent image visible so as to form a toner image, and transferring the toner image which is formed by developing to a transfer material, wherein the developing agent includes a color toner for forming an image containing:

a continuous phase of a resin containing a urea-modified polyester resin; and a modified resin dispersed in the continuous phase, wherein the modified resin contains:

a release polymer portion containing a release polymer; and a modified portion containing a plurality of vinyl monomer units, the modified portion having an average ester group concentration of 8% by weight to 30% by weight, wherein the color toner is formed by a process comprising:

emulsifying and suspending an organic solvent containing a modified polyester resin capable of forming a urea bond in an aqueous medium under an existence of a modified resin and a release agent;

allowing addition polymerization;

removing the organic solvent; and washing.

* * * * *